US012742234B2

(12) United States Patent
Nakano et al.

(10) Patent No.: US 12,742,234 B2
(45) Date of Patent: Sep. 22, 2026

(54) ALLOYED HOT-DIP GALVANIZED STEEL SHEET

(71) Applicant: NIPPON STEEL CORPORATION, Tokyo (JP)

(72) Inventors: Katsuya Nakano, Tokyo (JP); Shuntaro Matsuyama, Tokyo (JP); Taihei Kaneto, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 92 days.

(21) Appl. No.: 18/712,416

(22) PCT Filed: Jan. 28, 2022

(86) PCT No.: PCT/JP2022/003428
§ 371 (c)(1),
(2) Date: May 22, 2024

(87) PCT Pub. No.: WO2023/145025
PCT Pub. Date: Aug. 3, 2023

(65) Prior Publication Data

US 2025/0011911 A1 Jan. 9, 2025

(51) Int. Cl.

| | |
|---|---|
| ***C23C 2/06*** | (2006.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/14*** | (2006.01) |
| ***C23C 2/40*** | (2006.01) |

(52) U.S. Cl.
CPC ..... *C23C 2/06* (2013.01); *C21D 9/46* (2013.01); *C22C 38/001* (2013.01); *C22C 38/002* (2013.01); *C22C 38/004* (2013.01); *C22C 38/02* (2013.01); *C22C 38/04* (2013.01); *C22C 38/14* (2013.01); *C23C 2/40* (2013.01); *C21D 2211/001* (2013.01); *C21D 2211/002* (2013.01); *C21D 2211/005* (2013.01); *C21D 2211/008* (2013.01)

(58) Field of Classification Search
CPC ..... C23C 2/06; C23C 2/40; C22C 38/001; C22C 38/002; C22C 38/004; C22C 38/02; C22C 38/04; C22C 38/14; C21D 2211/001; C21D 2211/002; C21D 2211/005; C21D 2211/008
USPC ..... 428/659
See application file for complete search history.

(56) References Cited

U.S. PATENT DOCUMENTS

2004/0202889 A1* 10/2004 Fujita ..... C23C 2/28 148/533

FOREIGN PATENT DOCUMENTS

| | | |
|---|---|---|
| JP | 4-154937 A | 5/1992 |
| JP | 2014-58741 A | 4/2014 |

* cited by examiner

*Primary Examiner* — Katherine A Christy
(74) *Attorney, Agent, or Firm* — Birch, Stewart, Kolasch & Birch, LLP

(57) ABSTRACT

An alloyed hot-dip galvanized steel sheet excellent in appearance and press-formability, comprising a base steel sheet having a predetermined chemical composition. If the base steel sheet has a chemical composition containing, by mass %, Mn: 0.01 to 1.30%, the predetermined relationships of formulas (1) and (3) are satisfied and if the base steel sheet has a chemical composition containing, by mass %, Mn: 1.70 to 2.00%, the predetermined relationships of formulas (2) and (3) are satisfied. The amounts of Mn, P, S, Ti, and Nb detected in the extraction residue of the base steel sheet satisfy the predetermined relationship of formula (4). The average grain diameter of the base steel sheet is 7.5 μm or less.

7 Claims, No Drawings

ALLOYED HOT-DIP GALVANIZED STEEL SHEET

FIELD

The present application discloses an alloyed hot-dip galvanized (hot-dip galvannealed) steel sheet.

BACKGROUND

An alloyed hot-dip galvanized steel sheet is excellent in paintability etc., therefore is being made much use of for automobile body applications, first and foremost, and as external members of household electrical appliances, building materials, etc. For example, following PTLs 1 and 2 disclose the arts relating to alloyed hot-dip galvanized steel sheet.

The alloyed hot-dip galvanized steel sheet disclosed in PTL 1 has a base steel sheet and an alloyed hot-dip galvanized layer. The base steel sheet has a chemical composition containing, by mass %, C: 0.0060% or less, Si: 1.0% or less, Mn: 0.05% or more and 2.0% or less, P: 0.01% or more and 0.10% or less, S: 0.1% or less, Al: 0.005% or more and 0.1% or less, N: 0.0060% or less, and one or more of Nb, Ti, and B in Nb: 0.03% or more and 0.04% or less, Ti: 0.003% or more and 0.08% or less, and B: 0.0002% or more and 0.0040% or less in ranges and having a balance of Fe and impurities, the amount of Mn with respect to P being a predetermined ratio or more, and has a tensile strength of the base steel sheet of 35 kgf/mm$^2$ or more (about 343 MPa or more). In the alloyed hot-dip galvanized steel sheet disclosed in PTL 1, a high alloying speed is secured by making the amount of Mn with respect to P in the chemical composition of the base steel sheet a predetermined ratio or more.

The alloyed hot-dip galvanized steel sheet disclosed in PTL 2 has a base steel sheet having a chemical composition containing, by mass %, C: 0.0005 to 0.01%, Si: 0.001 to 1.0%, Mn: 0.01 to 2.5%, P: 0.001 to 0.1%, S: 0.02% or less, Al: 0.01 to 0.10%, Ti: 0.0001 to 0.1%, and N: 0.001 to 0.010% and having a balance of Fe and impurities, wherein the ratio {111}/{100} of the crystal orientations {111} and {100} of the steel sheet surface when a concentration of P in the base steel sheet is [P] and a concentration of Ti is [Ti] is (1-0.016×[P]/[Ti]) or more and (3.2−0.016×[P]/[Ti]) or less. The alloyed hot-dip galvanized steel sheet disclosed in PTL 2 is excellent in productivity and press-formability.

CITATIONS LIST

[Patent Literature]

[PTL 1] Japanese Unexamined Patent Publication No. 4-154937

[PTL 2] Japanese Unexamined Patent Publication No. 2014-058741

SUMMARY

Technical Problem

The alloyed hot-dip galvanized steel sheet made much use of as an external member etc. is required to feature good appearance with little unevenness of painting and unevenness of plating. In the prior art, the alloyed hot-dip galvanized steel sheet may not be made sufficiently uniform in surface properties and becomes poor in plating appearance. For example, in conventional alloyed hot-dip galvanized steel sheet, the wettability of the plating to the base steel sheet may be poor and plating defects may be formed. Further, in conventional alloyed hot-dip galvanized steel sheet, streaks easily form in the plating. The streaks remain even after painting. The appearance required as an external member cannot satisfied. That is, if streaks form in the plating and the plating appearance becomes poor, the appearance after painting also easily becomes poor.

Further, the alloyed hot-dip galvanized steel sheet used for the above applications is often used press-formed. In the prior art, at the time of press working the alloyed hot-dip galvanized steel sheet, nonalloyed plating may stick on the dies and impair the shapeability and productivity. Further, fracture may occur due to secondary work embrittlement.

As explained above, in conventional alloyed hot-dip galvanized steel sheet, the wettability of the base steel sheet by plating has been insufficient. There is room for improvement relating to suppressing formation of plating streaks, suppressing sticking of nonalloyed plating to the dies at the time of press working, and suppressing secondary work embrittlement.

Solution to Problem

The present application discloses, as one of the means for solving the above problem:

an alloyed hot-dip galvanized steel sheet, comprising a base steel sheet and plating layer, wherein a chemical composition of the base steel sheet comprises, by mass %, C: 0.0005 to 0.0100%,
Si: 0.01 to 0.50%,
Mn: 0.01 to 1.30% or 1.70 to 2.00%,
P: 0.100% or less,
S: 0.010% or less,
N: 0.0200% or less,
Ti: 0.040 to 0.180%,
Nb: 0 to 0.100%,
B: 0.0005 to 0.0100%,
Al: 0 to 1.000%,
Cu: 0 to 1.000%,
Cr: 0 to 2.000%,
Ni: 0 to 0.500%,
Mo: 0 to 3.000%,
W: 0 to 0.100%,
V: 0 to 1.000%,
O: 0 to 0.020%,
Ta: 0 to 0.100%,
Co: 0 to 3.000%,
Sn: 0 to 1.000%,
Sb: 0 to 0.500%,
As: 0 to 0.050%,
Mg: 0 to 0.050%,
Zr: 0 to 0.050%,
Ca: 0 to 0.0500%,
REM: 0 to 0.0500%, and
a balance: Fe and impurities, if Mn: 0.01 to 1.30%, the relationships of the following formulas (1) and (3) are satisfied, if Mn: 1.70 to 2.00%, the relationships of the following formulas (2) and (3) are satisfied, the amounts of Mn, P, S, Ti, and Nb in extraction residue obtained by analysis of the extraction residue of the base steel sheet satisfy the relationship of the following formula (4), and the average grain diameter of the base steel sheet is 7.5 μm or less $$130 \leq 100[Si] + 40[Mn] + 900[P] \quad (1)$$

$$160 \leq 100[Si] + 40[Mn] + 900[P] \quad (2)$$

$$15(2[C] - ([Ti] - 4[N])/3 - [Nb]/8) + 7[P] + [Si] + 20[B] \leq 0.75 \quad (3)$$

$$[C]/12 \leq [X_{Ti}]/48 + [X_{Nb}]/93 \leq [C]/12 + [N]/14 + [X_P]/31 - ([X_S]/32 - [X_{Mn}]/55) \quad (4)$$

In the above formulas (1) to (4),

[C], [Si], [Mn], [P], [N], [Ti], and [Nb] are contents of the elements in the chemical composition (mass %), $[X_{Ti}]$, $[X_{Nb}]$, $[X_P]$, $[X_S]$, and $[X_{Mn}]$ are expressed by the following formulas (A) to (E).

$$[X_{Ti}] = [(\text{Ti mass in extraction residue})/(\text{mass of electrolyzed base steel sheet})] \times 100 \quad (A)$$

$$[X_{Nb}] = [(\text{Nb mass in extraction residue})/(\text{mass of electrolyzed base steel sheet})] \times 100 \quad (B)$$

$$[X_P] = [(\text{P mass in extraction residue})/(\text{mass of electrolyzed base steel sheet})] \times 100 \quad (C)$$

$$[X_S] = [(\text{S mass in extraction residue})/(\text{mass of electrolyzed base steel sheet})] \times 100 \quad (D)$$

$$[X_{Mn}] = [(\text{Mn mass in extraction residue})/(\text{mass of electrolyzed base steel sheet})] \times 100 \quad (E)$$

In the alloyed hot-dip galvanized steel sheet of the present disclosure, the chemical composition may comprise, by mass %, one or more elements selected from the group consisting of:

Nb: 0.001 to 0.100%,
Al: 0.001 to 1.000%,
Cu: 0.001 to 1.000%,
Cr: 0.001 to 2.000%,
Ni: 0.001 to 0.500%,
Mo: 0.001 to 3.000%,
W: 0.001 to 0.100%,
V: 0.001 to 1.000%,
O: 0.001 to 0.020%,
Ta: 0.001 to 0.100%,
Co: 0.001 to 3.000%,
Sn: 0.001 to 1.000%,
Sb: 0.001 to 0.500%,
As: 0.001 to 0.050%,
Mg: 0.001 to 0.050%,
Zr: 0.001 to 0.050%,
Ca: 0.0001 to 0.0500%, and
REM: 0.0001 to 0.0500%.

In the alloyed hot-dip galvanized steel sheet of the present disclosure, the microstructure of the base steel sheet may be, by area ratio, ferrite: 94 to 100%,
total of martensite and bainite: 0 to 4%, and
retained austenite: 0 to 2%.

In the alloyed hot-dip galvanized steel sheet of the present disclosure, the chemical composition of the plating layer may comprise, by mass %, Fe: 5.0 to 25.0%,
Al: 0 to 1.0%,
Si: 0 to 1.0%,
Mg: 0 to 1.0%,
Mn: 0 to 1.0%,
Ni: 0 to 1.0%,
Sb: 0 to 1.0%, and
a balance: Zn and impurities.

Advantageous Effects of Invention

The alloyed hot-dip galvanized steel sheet of the present disclosure is excellent in wettability of plating to the base steel sheet, is suppressed in formation of plating streaks, is suppressed in sticking of nonalloyed plating on the die at the time of press working, and is easily suppressed in secondary work embrittlement as well. The alloyed hot-dip galvanized steel sheet of the present disclosure is excellent in appearance and excellent in shapeability and productivity at the time of press-forming.

DESCRIPTION OF EMBODIMENTS

Below, embodiments of the present invention will be explained. Note that, the explanation of these is simply intended to illustrate the embodiments of the present invention. The present invention is not limited to the following embodiments.

1. Alloyed Hot-Dip Galvanized Steel Sheet

The alloyed hot-dip galvanized steel sheet according to the present embodiment has a base steel sheet and a plating layer. The chemical composition of the base steel sheet comprises, by mass %, C: 0.0005 to 0.0100%,
Si: 0.01 to 0.50%,
Mn: 0.01 to 1.30% or 1.70 to 2.00%,
P: 0.100% or less,
S: 0.010% or less,
N: 0.0200% or less,
Ti: 0.040 to 0.180%,
Nb: 0 to 0.100%,
B: 0.0005 to 0.0100%,
Al: 0 to 1.000%,
Cu: 0 to 1.000%,
Cr: 0 to 2.000%,
Ni: 0 to 0.500%,
Mo: 0 to 3.000%,
W: 0 to 0.100%,
V: 0 to 1.000%,
O: 0 to 0.020%,
Ta: 0 to 0.100%,
Co: 0 to 3.000%,
Sn: 0 to 1.000%,
Sb: 0 to 0.500%,
As: 0 to 0.050%,
Mg: 0 to 0.050%,
Zr: 0 to 0.050%,
Ca: 0 to 0.0500%,
REM: 0 to 0.0500%, and
a balance: Fe and impurities, if Mn: 0.01 to 1.30%, the relationships of the following formulas (1) and (3) are satisfied, if Mn: 1.70 to 2.00%, the relationships of the following formulas (2) and (3) are satisfied, in the present embodiment, the amounts of Mn, P, S, Ti, and Nb in the extraction residue obtained by analysis of the extraction residue of the base steel sheet satisfy the relationship of the following formula (4), and, in the present embodiment, the average grain diameter of the base steel sheet is 7.5 μm or less.

$$130 \leq 100[Si] + 40[Mn] + 900[P] \quad (1)$$

$$160 \leq 100[Si] + 40[Mn] + 900[P] \quad (2)$$

$$15(2[C] - ([Ti] - 4[N])/3 - [Nb]/8) + 7[P] + [Si] + 20[B] \leq 0.75 \quad (3)$$

$$[C]/12 \leq [X_{Ti}]/48 + [X_{Nb}]/93 \leq [C]/12 + [N]/14 + [X_P]/31 - ([X_S]/32 - [X_{Mn}]/55) \quad (4)$$

In the above formulas (1) to (4),

[C], [Si], [Mn], [P], [N], [Ti], and [Nb] are contents (mass %) of the elements in the chemical composition, and $[X_{Ti}]$, $[X_{Nb}]$, $[X_P]$, $[X_S]$, and $[X_{Mn}]$ are expressed by the following formulas (A) to (E).

$$[X_{Ti}] = [(\text{Ti mass in extraction residue})/(\text{mass of electrolyzed base steel sheet})] \times 100 \quad (A)$$

$$[X_{Nb}] = [(\text{Nb mass in extraction residue})/(\text{mass of electrolyzed base steel sheet})] \times 100 \quad (B)$$

$$[X_P] = [(\text{P mass in extraction residue})/(\text{mass of electrolyzed base steel sheet})] \times 100 \quad (C)$$

$$[X_S] = [(\text{S mass in extraction residue})/(\text{mass of electrolyzed base steel sheet})] \times 100 \quad (D)$$

$$[X_{Mn}] = [(\text{Mn mass in extraction residue})/(\text{mass of electrolyzed base steel sheet})] \times 100 \quad (E)$$

For example, in the analysis of the extraction residue, if all of Ti in the electrolyzed base steel sheet is contained in the extraction residue, $[X_{Ti}]$=[Ti].

1.1. Chemical Composition of Base Steel Sheet

First, the reasons for limitation of the chemical composition of the base steel sheet will be explained. The "%" for the constituents here means mass %. Furthermore, in this Description, "to" showing numerical ranges, unless otherwise indicated, is used in the sense having the numerical values described before and after it as lower limit values and upper limit values.

(C: 0.0005 to 0.0100%)

The less the C in the base steel sheet, the more the mechanical properties such as the elongation and r-value are improved. In the present embodiment, C can be pinned by the later explained Ti or Nb, but if TiC or NbC increases too much, the dependency of mechanical properties of the base steel sheet on the annealing temperature becomes higher and the range of annealing conditions for obtaining the desired mechanical properties is liable to become narrower. On this point, the C content is 0.0100% or less. The upper limit of the C content may also be 0.0080%, 0.0070%, 0.0060%, 0.0050%, or 0.0040%. Further, from the viewpoint of suppressing an excessive rise in the steelmaking costs, the C content is 0.0005% or more. The lower limit of the C content may also be 0.0010%, 0.0015%, 0.0020%, 0.0025%, or 0.0030%.

(Si: 0.01 to 0.50%)

Si is an element for improving the strength of the base steel sheet. On the other hand, if the base steel sheet excessively contains Si, the wettability of the plating to the base steel sheet may deteriorate. On this point, the Si content is 0.50% or less. The upper limit of the Si content may also be 0.45%, 0.40%, or 0.35%. The lower limit of the Si content can be determined from the relationship with formula (1) or formula (2). For deoxidation, the Si content is 0.01% or more. The lower limit of the Si content may also be 0.05%, 0.10%, 0.20%, or 0.25%.

(Mn: 0.01 to 1.30% or 1.70 to 2.00%)

Mn is an element improving the strength of the base steel sheet. However, according to new findings of the inventors, if the Mn content in the base steel sheet is within a specific range, remarkable unevenness of Mn concentration occurs at the surface of the base steel sheet, unevenness occurs in the alloying speed of the plating due to this remarkable unevenness of Mn concentration, and streak-shaped defects in appearance (plating streaks) can occur at the plating surface of the alloyed hot-dip galvanized steel sheet. If the Mn content is small, unevenness of Mn concentration hardly ever occurs to an extent causing streak-shaped defects in the appearance. Further, if the Mn content is great, the Mn concentration rises at the surface of the base steel sheet as a whole and unevenness of the Mn concentration is easily eliminated. However, if the Mn content is excessively large, the elongation of the steel sheet is liable to fall. Considering the above, in the present embodiment, from the viewpoint of improving the appearance of the alloyed hot-dip galvanized steel sheet and securing the elongation, the Mn content is 0.01 to 1.30% or 1.70 to 2.00%. The lower limit of the Mn content may also be 0.10%, 0.35%, 0.50%, 0.65%, or 0.80%. The upper limit of the Mn content may also be 1.25%, 1.20%, or 1.15%. For example, the Mn content may be 0.65 to 1.30%. Alternatively, the Mn content may be 1.75 to 1.95%.

(P: 0.100% or Less)

P is an element for improving the strength of the base steel sheet. On the other hand, if the base steel sheet contains P in excess, the plating becomes slower in alloying, the amount of nonalloyed plating becomes greater at the alloyed hot-dip galvanized steel sheet, and nonalloyed plating may stick to the dies and impair the shapeability and productivity at the time of press working. On this point, the P content is 0.100% or less. The upper limit of the P content may also be 0.090%, 0.070%, 0.060%, or 0.050%. The lower limit of the P content can, for example, also be determined from the relationship with the formula (1) or formula (2). For this reason, if the Mn content is 0.01 to 1.30%, the lower limit of the P content is 0.031%, while if the Mn content is 0.70 to 2.00%, the lower limit of the P content is 0.033%. For this reason, the lower limit of the P content may also be 0.031% or 0.033%.

(S: 0.010% or Less)

S is an element segregating at the grain boundaries of the base steel sheet and causing secondary work embrittlement. Further, it is an element forming MnS and other nonmetallic inclusions in the steel and inviting a drop in ductility of the base steel sheet. The less the better. The Si content is 0.010% or less. The upper limit of the Si content may also be 0.009%, 0.008%, 0.007%, or 0.006%. The lower limit of the S content is 0%. The lower limit of the Si content may also be 0.001% or 0.002%.

(N: 0.0200% or Less)

N is an element forming coarse nitrides in the base steel sheet and causing the workability of the steel sheet to fall.

Further, N is an element which becomes a cause of formation of blowholes at the time of welding. Further, if excessively including N, it bonds with Ti to cause the formation of TiN whereupon the amount of Ti effective for pinning the C is liable to fall. On this point, the N content is 0.0200% or less. The upper limit of the N content may also be 0.0150%, 0.0100%, 0.0080%, or 0.0060%. Further, the lower limit of the N content is 0%, but from the viewpoint of suppressing an excessive rise in the steelmaking cost, the lower limit of the N content may also be 0.0001% or 0.0010%.

(Ti: 0.040 to 0.180%)

Ti is an element pinning C to improve the mechanical properties such as the elongation and r-value of the base steel sheet. If the Ti content is 0.040% or more, such an effect is easily obtained. On the other hand, if the Ti content is too great, the balance between the strength and ductility of the base steel sheet is liable to deteriorate. If the Ti content is 0.180% or less, such a problem is easily avoided. For this reason, the Ti content is 0.040 to 0.180%. The lower limit of the Ti content may also be 0.045% or 0.050%. The upper limit of the Ti content may also be 0.150%, 0.120%, or 0.100%.

(Nb: 0 to 0.100%)

Nb, like Ti, is an element pinning C to improve the mechanical properties such as the elongation and r-value of the base steel sheet. However, this effect is weaker than with Ti. As explained above, if a sufficient effect of pinning C is obtained by Ti, the Nb content may also be 0%. The Nb content may also be 0.001%, 0.005%, 0.010%, or 0.015%. On the other hand, if the Nb content is too great, the dependency of mechanical properties of the base steel sheet on the annealing temperature becomes higher and the range of annealing conditions for obtaining the desired mechanical properties is liable to become narrower. On this point, the Nb content is 0.100% or less. The upper limit of the Nb content may also be 0.060%, 0.050%, 0.040%, or 0.030%.

(B: 0.0005 to 0.0100%)

B is an element for preventing secondary work embrittlement of the base steel sheet. In the present embodiment, as explained above, it is possible to pin C by Ti and Nb and remove the C at the grain boundaries, but if removing C at the grain boundaries, secondary work embrittlement becomes easier to occur. In the present embodiment, by making the base steel sheet include B instead of C, such a problem becomes easy to avoid. To make it much easier to avoid such a problem, the B content is 0.0005% or more. The lower limit of the B content may be 0.0007% or 0.0009%. On the other hand, if the base steel sheet excessively contains B, the plating becomes slower to alloy, the amount of nonalloyed plating at the alloyed hot-dip galvanized steel sheet becomes greater, and at the time of press working, that nonalloyed plating sticks to the dies and easily impairs the shapeability and productivity. On this point, the B content is 0.0100% or less. The upper limit of the B content may also be 0.0050%, 0.0030%, or 0.0020%

(Al: 0 to 1.000%)

Al is an element acting as a deoxidizer of steel and is added according to need. On the other hand, if excessively containing Al, the balance of strength and ductility may deteriorate. The lower limit of the Al content is 0%, but may also be 0.001%, 0.005%, 0.010%, or 0.015%. Further, the Al content is 1.000% or less. The upper limit of the Al content may also be 0.800%, 0.600%, 0.400%, 0.200%, 0.100%, 0.080%, 0.060%, or 0.040%.

The basic chemical composition of the base steel sheet in the present embodiment is as explained above. Further, the base steel sheet in the present embodiment may contain at least one of the following elements in accordance with need. These elements need not be contained, therefore the lower limits of the contents are 0%.

(Cu: 0 to 1.000%)

Cu is an element able to contribute to improvement of at least one of the strength and corrosion resistance. On the other hand, if excessively containing Cu, deterioration of the toughness is liable to be invited. For this reason, the Cu content is 1.000% or less. The upper limit of the Cu content may also be 0.800%, 0.600%, 0.400%, 0.250%, or 0.150%. The lower limit of the Cu content is 0%. The lower limit of the Cu content may also be 0.001%, 0.010%, 0.050%, or 0.100%.

(Cr: 0 to 2.000%)

Cr is an element raising the quenchability of steel and able to contribute to improvement of at least one of the strength and corrosion resistance. On the other hand, if excessively containing Cr, in addition to the alloy cost, the toughness may fall. For this reason, the Cr content is 2.000% or less. The upper limit of the Cr content may also be 1.500%, 1.000%, 0.500%, 0.300%, or 0.150%. The lower limit of the Cr content is 0%, but may also be 0.001%, 0.010%, 0.050%, or 0.100%.

(Ni: 0 to 0.500%)

Ni is an element raising the quenchability of steel and able to contribute to improvement of at least one of the strength and heat resistance. On the other hand, if excessively containing Ni, the effect becomes saturated and a rise in the production costs is invited. For this reason, the Ni content is 0.500% or less. The upper limit of the Ni content may also be 0.400%, 0.300%, 0.200%, or 0.100%. The lower limit of the Ni content is 0%, but may also be 0.001%, 0.010%, 0.030%, or 0.050%.

(Mo: 0 to 3.000%)

Mo is an element raising the quenchability of steel and able to contribute to improvement of at least one of the strength and corrosion resistance. On the other hand, if excessively containing Mn, the deformation resistance at the time of working is liable to increase. For this reason, the Mo content is 3.000% or less. The upper limit of the Mo content may also be 2.000%, 1.000%, 0.500%, or 0.100%. The lower limit of the Mo content is 0%, but may also be 0.001%, 0.005%, 0.010%, or 0.020%.

(W: 0 to 0.100%)

W is an element raising the quenchability of steel and able to contribute to improvement of the strength. On the other hand, if excessively containing W, coarse inclusions are liable to be formed. For this reason, the W content is 0.100% or less. The upper limit of the W content may also be 0.080%, 0.050%, or 0.030%. The lower limit of the W content is 0%, but may also be 0.001%, 0.005%, or 0.010%.

(V: 0 to 1.000%)

V is an element able to contribute to improvement of the strength by precipitation strengthening etc. On the other hand, if excessively containing V, a large amount of precipitates may be formed and the toughness is made to fall. For this reason, the V content is 1.000% or less. The upper limit of the V content may also be 0.800%, 0.500%, 0.300%, 0.100%, or 0.070%. The lower limit of the V content is 0%, but may also be 0.001%, 0.010%, 0.030%, or 0.050%.

(O: 0 to 0.020%)

O is an element able to enter in the production process. The lower limit of the O content is 0%. However, to decrease the O content to an extreme extent, time is required for refining and a drop in the productivity is invited. On the other hand, if excessively containing O, coarse inclusions may be formed and the toughness of the steel material is made to fall. For this reason, the O content is 0.020% or less. The upper limit of the O content may also be 0.015%, 0.010%, 0.005%, or 0.003%. The lower limit of the O content may also be 0.001% or 0.002%.

(Ta: 0 to 0.100%)

Ta is an element able to contribute to control of the form of the carbides and increase of strength. On the other hand, if excessively containing Ta, a large amount of fine Ta carbides precipitate and the toughness is liable to fall. For this reason, the Ta content is 0.100% or less. The upper limit of the Ta content may also be 0.080%, 0.060%, 0.040%, 0.020%, or 0.010%. The lower limit of the Ta content is 0%, but may also be 0.001% or 0.005%.

(Co: 0 to 3.000%)

Co is an element able to contribute to improvement of at least one of quenchability and heat resistance. On the other hand, if excessively containing Co, the workability is liable to fall and an increase of the cost of materials is led to. For this reason, the Co content is 3.000% or less. The upper limit of the Co content may also be 2.000%, 1.000%, 0.500%, 0.200%, or 0.100%. The lower limit of the Co content is 0%, but may also be 0.001%, 0.010%, 0.020%, or 0.050%.

(Sn: 0 to 1.000%)

Sn is an element able to contribute to improvement of corrosion resistance. On the other hand, if excessively containing Sn, a drop in toughness is liable to be invited. For this reason, the Sn content is 1.000% or less. The upper limit of the Sn content may also be 0.800%, 0.500%, 0.300%, 0.100%, or 0.050%. The lower limit of the Sn content is 0%, but may also be 0.001%, 0.005%, 0.010%, or 0.020%.

(Sb: 0 to 0.500%)

Sb is an element able to contribute to improvement of corrosion resistance. On the other hand, if excessively containing Sb, a drop in toughness is liable to be invited. For this reason, the Sb content is 0.500% or less. The upper limit of the Sb content may also be 0.300%, 0.100%, or 0.050%. The lower limit of the Sb content is 0%, but may also be 0.001%, 0.005%, or 0.010%.

(As: 0 to 0.050%)

As is an element able to contribute to improvement of the machineability of steel. On the other hand, if excessively containing As, the workability is liable to fall. For this reason, the As content is 0.050% or less. The upper limit of the As content may also be 0.040%, 0.030%, or 0.020%. The lower limit of the As content is 0%, but may also be 0.001%, 0.005%, or 0.010% or more.

(Mg: 0 to 0.050%)

Mg is an element able to contribute to control of the form of sulfides. On the other hand, if excessively containing Mg, the toughness is liable to fall. For this reason, the Mg content is 0.050% or less. The upper limit of the Mg content may also be 0.030%, 0.020%, or 0.015%. The lower limit of the Mg content is 0%, but may also be 0.001%, 0.003%, or 0.005%.

(Zr: 0 to 0.050%)

Zr is an element able to contribute to control of the form of sulfides. On the other hand, if excessively containing Zr, the effect becomes saturated and a rise in the cost of production is liable to be invited. For this reason, the Zr content is 0.050% or less. The upper limit of the Zr content may also be 0.040%, 0.030%, or 0.020%. The lower limit of the Zr content is 0%, but may also be 0.001%, 0.003%, 0.005%, or 0.010%.

(Ca: 0 to 0.0500%)

Ca is an element able to control the form of sulfides by trace addition. On the other hand, if excessively containing Ca, the effect becomes saturated and a rise in the cost of production is liable to be invited. For this reason, the Ca content is 0.0500% or less. The upper limit of the Ca content may also be 0.0300%, 0.0200%, 0.0100%, 0.0070%, or 0.0040%. The lower limit of the Ca content is 0%, but may also be 0.0001%, 0.0005%, 0.0010%, or 0.0020%.

(REM: 0 to 0.0500%)

REM, in the same way as Ca, is an element able to control the form of sulfides by trace addition. On the other hand, if excessively containing REM, coarse inclusions are liable to be formed. For this reason, the REM content is 0.0500% or less. The upper limit of the REM content may also be 0.0300%, 0.0200%, 0.0100%, 0.0070%, or 0.0040%. The lower limit of the REM content is 0%, but may also be 0.0001%, 0.0005%, 0.0010%, or 0.0020%. Further, in this Description, "REM" is the general term of the 17 elements of scandium (Sc) of atomic number 21, yttrium (Y) of atomic number 39, and the lanthanoids of lanthanum (La) of atomic number 57 to lutetium (Lu) of atomic number 71. The REM content is the total content of these elements.

In the base steel sheet in the present embodiment, the balance besides the constituents explained above is Fe and impurities. The "impurities" are constituents etc. entering due to various factors in the production process, such as first and foremost materials such as the ore and scrap, when industrially producing the base steel sheet according to the present embodiment.

1.2. Formulas (1) to (4)

In the present embodiment, if the chemical composition of the base steel sheet includes, by mass %, Mn: 0.01 to 1.30%, the chemical composition has to satisfy the relationships of the following formulas (1) and (3). Alternatively, in the present embodiment, if the chemical composition of the base steel sheet includes, by mass %, Mn: 1.70 to 2.00%, the chemical composition has to satisfy the relationships of the following formulas (2) and (3). Further, in the present embodiment, the amounts of Mn, P. S. Ti, and Nb in the extraction residue obtained by analysis of the extraction residue of the base steel sheet have to satisfy the relationship of the following formula (4).

$$130 \leq 100[Si] + 40[Mn] + 900[P]) \quad \text{(Formula (1)}$$

Formula (1) is related to the strength of the base steel sheet. That is, in the present embodiment, if the base steel sheet satisfies the above formula (1), a high strength is easy to secure in the base steel sheet. The lower limit value at the left side of formula (1) is 130 and may also be 135 and may also be 140. The upper limit value relating to the right side of the formula (1) is inherently determined from the above-mentioned upper limits of the Si content, Mn content, and P content. Further, as explained above, in the present embodiment, formula (1) is applied in the case where the Mn content in the above-mentioned chemical composition is 0.01 to 1.30%. In this way, to secure sufficient strength in the base steel sheet in the region of a low Mn content, addition of at least one of Si and P is essential. On the other hand, as explained above. Si and P are elements affecting the wettability by plating and the alloying speed. Si and P cannot be excessively contained. Further, according to findings of the inventors, in the region where the Mn content is a low 0.01 to 1.30%, the appearance of the plating is improved, but the plating becomes slower to alloy, the amount of nonalloyed plating at the alloyed hot-dip galvanized steel sheet becomes greater, and at the time of press working, that nonalloyed plating sticks to the dies and easily impairs the shapeability and productivity. On this point, in the present embodiment, the base steel sheet satisfies not only formula (1) but also formulas (3) and (4), whereby the alloying speed of the plating rises and the shapeability and productivity at the time of press working can be improved.

$$160 \leq 100[Si]+40[Mn]+900[P]) \quad \text{(Formula (2)}$$

Formula (2) also, like formula (1), is related to the strength of the base steel sheet. That is, in the present embodiment, if the base steel sheet satisfies the above formula (2), a much higher strength is easy to secure in the base steel sheet. The lower limit value at the left side of formula (2) is 160 and may also be 180 and may also be 200. The upper limit value relating to the right side of the formula (2) is inherently determined from the above-mentioned upper limits of the Si content. Mn content, and P content. Further, as explained above, in the present embodiment, formula (2) is applied in the case where the Mn content in the above-mentioned chemical composition is 1.70 to 2.00%. Here, if adding a large amount of at least one of Si and P in addition to Mn so as to satisfy the above formula (2), the strength of the base steel sheet is improved, but due to Si and P, the plating becomes slower to alloy, the amount of nonalloyed plating at the alloyed hot-dip galvanized steel sheet becomes greater, and at the time of press working, that nonalloyed plating sticks to the dies and easily impairs the shapeability and productivity. On this point, in the present embodiment, the base steel sheet satisfies not only formula (2) but also formulas (3) and (4), whereby the alloying speed of the plating rises and the shapeability and productivity at the time of press working can be improved.

$$15(2[C]-([Ti]-4[N])/3-[Nb]/8)+7[P]+[Si]+20[B] \leq 0.75) \quad \text{(Formula (3)}$$

As explained above, formula (3) is related to the alloying speed of the plating. The left side of formula (3) is an indicator related to the alloying time, while the right side is a threshold value determined from the alloying time allowed considering productivity. The first term of the left side ("15(2[C]-([Ti]-4[N])/3-[Nb]/8)") is a term considering obstruction of alloying by the dissolved C remaining without being pinned by Ti or Nb. The second term to the fourth term of the left side (7[P], [Si], and 20[B]) are terms considering obstruction of alloying by P. Si. and B. It means that the smaller the value of the left side of formula (3), the less obstruction of alloying and the higher the alloying speed that can be secured. That is, in the present embodiment, in the base steel sheet, by the contents of C, Ti, N, Nb, P, Si, and B being adjusted so that the above formula (3) is satisfied, it becomes easier to pin C by Ti or Nb in the base steel sheet and becomes easier to decrease the C obstructing diffusion of Fe at the time of alloying of the plating (in particular, C segregated at the grain boundaries). As a result, at the time of alloying of the plating. Fe more easily diffuses from the base steel sheet to the plating layer, a high alloying speed is secured, and there is less nonalloyed plating at the alloyed hot-dip galvanized steel sheet. For this reason, sticking of the nonalloyed plating to the dies at the time of press working is suppressed and the shapeability and productivity at the time of press working become easier to improve. The upper limit value of the right side of formula (3) is 0.75 and may be 0.74, may be 0.73, may be 0.72, may be 0.71, and may be 0.70.

$$[C]/12 \leq [X_{Ti}]/48+[X_{Nb}]/93 \leq [C]/12+[N]/14+[X_P]/31-([X_S]/32-[X_{Mn}]/55)) \quad \text{(Formula (4)}$$

Formula (4), like formula (3), is related to the alloying speed of the plating. What extent the C segregated at the grain boundaries was reduced by Ti and Nb is learned by analyzing the constituents contained in the extraction residue obtained by analysis of the extraction residue of the base steel sheet. In the present embodiment, it is difficult to directly measure the grain boundary C of the base steel sheet, therefore the amount of grain boundary C is indirectly defined by the amount of precipitated carbides etc. Specifically, the base steel sheet is made to dissolve in the later explained solvent (also referred to as the electrolytic solution) by analysis of the extraction residue, the precipitates (carbides etc.) are separated from the base steel sheet by filtration, and the mass %'s of Ti and Nb in the extraction residue are measured by chemical analysis. The lower limit of formula (4) ([C]/12) corresponds to the case where the entire amounts of Ti and Nb become TiC and NbC. The upper limit of formula (4) ([C]/12+ [N]/14+ $[X_P]$/31-($[X_S]$/32-$[X_{Mn}]$/55)) corresponds to the case where part of the Ti is consumed by other precipitates besides TiC (may be at least one of TiN, FeTiP, $Ti_4C_2S_2$, and MnS. Further, TiS is small enough to be able to be ignored, therefore does not have to be considered). If the amounts of Ti and Nb in the extraction residue ($[X_{Ti}]$ and $[X_{Nb}]$) are within the range of the above formula (4), it can be said that the amount of C segregated at the grain boundaries is sufficiently reduced by Ti and Nb (remains as TiC, NbC, etc.) As a result, at the time of alloying of the plating. Fe more easily diffuses from the base steel sheet to the plating layer, a high alloying speed is secured, and there is less nonalloyed plating at the alloyed hot-dip galvanized steel sheet. For this reason, sticking of the nonalloyed plating to the dies at the time of press working is suppressed and the shapeability and productivity at the time of press working become easier to improve.

Further, the analysis of the extraction residue is performed by the following procedure. First, the base steel sheet is electrolyzed in a solvent (acetylacetone-tetramethylammonium chloride-methanol solution, usually called an "AA solution") to make a certain amount dissolve. At this time, the precipitate in the base steel sheet does not dissolve but separates from the base steel sheet and settles in the solution. The solution is filtered to obtain the residue (this corresponds to the precipitate), then the residue is chemically analyzed and the elements in the residue (that is, the precipitate) are analyzed. The analysis of elements in the extraction residue can, for example, be performed by absorption spectrophotometry (equipment used: UVmini-1240 made by Shimadzu) etc.

1.3. Average Grain Diameter

According to the findings of the inventors, by reducing the grain size of the base steel sheet by a certain extent to improve the work hardenability, the strength and ductility can be simultaneously improved. On this point, in the present embodiment, it is important that the average grain diameter of the base steel sheet be 7.5 μm or less. The average grain diameter may also be 7.0 μm or less, 6.5 μm or less, or 6.0 μm or less. The lower limit of the average grain diameter is not particularly prescribed. For example, the lower limit of the average grain diameter may be 1.0 μm, 2.0 μm, 3.0 μm, or 4.0μ m.

The average grain diameter at the base steel sheet is measured by the following procedure. That is, a test piece with a cross-section vertical to the rolling direction of the steel forming the examined surface is taken. The test piece is buried in a resin etc. and polished etc. After that, an EBSD apparatus is used to obtain the distribution of crystal orientations for each examined field (10000 $\mu m^2$ per field), a difference in orientation of 15° or more is defined as a grain boundary, the average area "a" for each grain is found, and the grain size "d" is found from the formula $d=2(a/\pi)^{0.5}$. The number of examined fields is made four fields at the center part in sheet thickness, two fields each (total four fields) at sheet thickness ¼ positions from the two surfaces, and two fields each (total four fields) near the two surfaces for a total of 12 fields. In the examination of these fields, the average grain diameter is calculated from the obtained average values of the grain sizes.

1.4. Microstructure

The microstructure of the base steel sheet is not particularly limited and can be adjusted in accordance with the performance sought from the base steel sheet. In the present embodiment, the microstructure of the base steel sheet may be, by area ratio, for example, ferrite: 94 to 100%, total of martensite and bainite: 0 to 4%, and, retained austenite: 0 to 2%. The area ratios of the phases and structures can, for example, by identified in the following way.

The area ratio of the retained austenite is determined by X-ray measurement in the following way. First, the part of the steel sheet from the surface to ¼ of the thickness of the steel sheet is removed by mechanical polishing and chemical polishing and the chemically polished surface is measured using Mokα rays as the characteristic X-rays. Further, from the integrated intensity ratio of the diffraction peaks of (200) and (211) of the body centered cubic (bcc) phase and (200), (220), and (311) of the face centered cubic (fcc) phase, the following formula is used to calculate the area percentage of the retained austenite of the center part of sheet thickness:

$$S_\gamma = (I200f + I220f + I311f)/(I200b + I211b) \times 100$$

where, Sγ shows the area ratio of the retained austenite of the sheet thickness ¼ part, I200f, I220f, and I311f show the intensities of the diffraction peaks of (200), (220), and (311) of the fcc phase, and I200b and I211b show the intensities of the diffraction peaks of (200) and (211) the bcc phase. Note that, inherently, Sγ is the volume ratio, but is equal to the area ratio, therefore Sγ is deemed the area ratio.

The total of the area ratio of the martensite and the area ratio of the bainite and the area ratio of the ferrite are measured as follows: First, a sample is taken having the cross-section parallel to the rolling direction of the base steel sheet and sheet thickness direction as an examined surface and the examined surface is polished and etched by Nital. Next, at two fields each (total four fields) at sheet thickness ¼ positions from the two surfaces and two fields each (total four fields) near the two surfaces for a total of 12 fields, a total of four fields, each field being 1000 $\mu m^2$ or more, are examined. Further, the area ratio (A) able to be identified as bainite or martensite, the area ratio of ferrite, etc. are measured. Here, in identification of the structures by analysis by an optical microscope, retained austenite is identified as martensite and bainite, therefore that area ratio (A) minus the area ratio (B) of the retained austenite measured by the above-mentioned X-ray diffraction, that is, "A−B", is made the area ratio of the total of the area ratio of martensite and the area ratio of bainite.

1.5. Plating Layer

The alloyed hot-dip galvanized steel sheet according to the present embodiment has the above-mentioned base steel sheet and plating layer. The plating layer is formed on at least one surface of the base steel sheet. The plating layer may be an alloyed hot-dip galvanized layer having a structure known to persons skilled in the art. For example, the plating layer may include Al and other added elements besides Zn. In the alloyed hot-dip galvanized steel sheet according to the present embodiment, the chemical composition of the plating layer may be, for example, by mass %, Fe: 5.0 to 25.0%, Al: 0 to 1.0%, Si: 0 to 1.0%, Mg: 0 to 1.0%, Mn: 0 to 1.0%, Ni: 0 to 1.0%, Sb: 0) to 1.0%, and a balance: Zn and impurities. The Al content at the plating layer may be more than 0 mass % or 0.1 mass % or more. The amount of deposition of the plating layer is not particularly limited and may be a general amount of deposition. In accordance with need, the lower limit of the Fe content may be 8.0% or 10.0%. The lower limit of the Al content may also be 0.1% or 0.2% while the upper limit of the Al content may be 0.8% or 0.6%. Furthermore, the upper limit of the Si content, Mg content, Mn content, or Ni content may also be 0.8%, 0.6%, or 0.4%.

The chemical composition of the plating layer can, for example, by identified by the following procedure. That is, a paint remover not corroding the plating (for example, Neorever SP-751 made by Sansaikako Co., Ltd.) is used to remove the surface paint film, then hydrochloric acid containing an inhibitor (for example, Hibiron made by Sugimura Chemical Industrial Co., Ltd.) is used to dissolve the plating layer and the obtained solution is sent on to inductively coupled plasma (ICP) emission spectrometry to be able to find the chemical composition of the plating layer.

1.6. Other Properties of Alloyed Hot-Dip Galvanized Steel Sheet

The alloyed hot-dip galvanized steel sheet in the present embodiment need only be one in which the base steel sheet has the above-mentioned chemical composition, the above formulas (1) to (4) are satisfied, and the above average grain size is exhibited. Further, the alloyed hot-dip galvanized steel sheet in the present embodiment may also have the following properties.

(Tensile Strength TS)

To lighten the weight of structural members using steel materials and improve the resistance of structural members in plastic deformation, it is preferable that the steel material have a large work hardening ability and exhibit its maximum strength. On the other hand, if the tensile strength (TS) of the steel sheet is too large, fracture more easily occurs by a low energy during the plastic deformation and the shapeability may fall. If the Mn content of the base steel sheet is, by mass %, 0.01 to 1.30%, the tensile strength of the alloyed hot-dip galvanized steel sheet may be, for example, 430 MPa or more, 440 MPa or more, or 450 MPa or more and, further, may be 550 MPa or less, 510 MPa or less, or 500 MPa or less. Alternatively, if the Mn content of the base steel sheet is, by mass %, 1.70 to 2.00%, the tensile strength of the alloyed hot-dip galvanized steel sheet may, for example, be 480 MPa or more, 500 MPa or more, or 520 MPa or more and, further, may be 600 MPa or less, 580 MPa or less, or 550 MPa or less.

(Total Elongation EL)

When shaping steel sheet cold to manufacture a structural member, the steel sheet requires elongation so as to finish it into a complicated shape. If the total elongation of the steel sheet is too low; the material may fracture in the cold shaping. The total elongation of the steel sheet is not particularly limited, but, for example, may be 25% or more, 26% or more, 27% or more, 28% or more, 29% or more, or 30% or more, and may be 40% or less, 39% or less, 38% or less, 37% or less, 36% or less, or 35% or less. In particular, if the Mn content of the base steel sheet is, by mass %, 0 to 1.30%, the total elongation of the steel sheet is preferably 29% or more or 30% or more. If the Mn content of the base steel sheet is, by mass %, 1.70 to 2.00%, the total elongation of the steel sheet is preferably 27% or more, 28% or more, or 29% or more.

(Yield Point YP)

In the present embodiment, the yield point of the steel sheet is not particularly limited, but, for example, if the Mn content of the base steel sheet is, by mass %, 0 to 1.30%, may be 195 MPa or more, 200 MPa or more, or 210 MPa or more and, further, may be 360 MPa or less, 340 MPa or less, or 320 MPa or less. Further, if the Mn content of the base steel sheet is, by mass %, 1.70 to 2.00%, the yield point may be 300 MPa or more, 320 MPa or more, or 340 MPa or more and, further, 420 MPa or less, 400 MPa or less, or 380 MPa or less.

(Methods of Measurement of Tensile Strength, Total Elongation, and Yield Point)

The tensile test for measuring the tensile strength, total elongation, and yield point is based on JIS Z 2241:2011. A No. 5 test piece is taken such that an orientation at which the long direction of the test piece becomes parallel to the direction perpendicular to rolling of the steel strip.

(Sheet Thickness)

The sheet thickness of the base steel sheet is a factor affecting the rigidity of a steel member after shaping. The greater the sheet thickness, the higher the rigidity of the member. If the sheet thickness is too small, a drop in rigidity is invited and the press-formability may fall due to the effect of the unavoidable nonferrous inclusions present inside the steel sheet. On the other hand, if the sheet thickness is too great, the press-forming load increases and wear of the dies and a drop of productivity may be invited. The thickness of the base steel sheet is not particularly limited, but may be 0.2 mm or more or 0.5 mm or more and may be 6.0 mm or less, 5.0 mm or less, or 4.0 mm or less.

1.7. Effects

As explained above, the alloyed hot-dip galvanized steel sheet according to the present embodiment has an Mn content at the base steel sheet of 0 to 1.30% or 1.70 to 2.00% and thereby is resistant to formation of unevenness of Mn concentration at the steel sheet surface and is excellent in appearance (plating appearance or painting appearance). Further, the base steel sheet satisfies the predetermined formula (1) or (2) and has an average grain diameter of 7.5 μm or less and thereby is excellent in balance of strength and ductility. Further, the base steel sheet satisfies the predetermined formulas (3) and (4) whereby the alloying speed of the plating rises, there is less nonalloyed plating, and the shapeability at the time of press-forming and the productivity are improved.

2. Method of Production of Alloyed Hot-Dip Galvanized Steel Sheet

The alloyed hot-dip galvanized steel sheet according to the present embodiment can be produced by integrated control of hot rolling, cold rolling, and annealing. In particular, the cooling conditions and the coiling conditions after the end of hot finish rolling are important. Below, one example of the method of production of the alloyed hot-dip galvanized steel sheet will be explained, but the method of production of the alloyed hot-dip galvanized steel sheet is not limited to the following examples.

The method of production of the alloyed hot-dip galvanized steel sheet according to one embodiment includes hot rolling a steel slab having the above chemical composition to obtain a hot rolled steel sheet, coiling the hot rolled steel sheet, cold rolling the hot rolled steel sheet to obtain a cold rolled steel sheet, and annealing the cold rolled steel sheet.

The hot rolled steel sheet is started to be cooled within 0.5 second after the end of the finish rolling of the hot rolling at a cooling speed of 15° C./s or more and is rapidly cooled at that cooling speed down to a rapid cooling stop temperature of 600° C. or more and 700° C. or less. After that, the hot rolled steel sheet is slow cooled from the rapid cooling stop temperature to the coiling temperature at a cooling speed of 5.0° C./s or less and is coiled up at a coiling temperature of 150° C. or less. Below, the steps will be explained in detail focusing on parts of the points of the present embodiment.

2.1. Cooling Conditions after End of Hot Finish Rolling

In the present embodiment, to promote the progression of recovery at the initial stage of the annealing and make the structure after annealing finer, the hot rolled steel sheet is rapidly cooled by a predetermined cooling speed within 0.5 second after the end of hot finish rolling and is cooled down to the rapid cooling stop temperature of 600° C. or more and 700° C. or less. The time from after the end of the hot finish rolling to the start of cooling is preferably within 0.3 second. The reason why rapidly cooling the hot rolled steel sheet right after the end of hot finish rolling causes the structure after annealing to become finer is believed to be based on the following mechanism.

The orientations of the base steel sheet after cold rolling can include a majority of {111}<112> and a minority of {111}<110>. If not rapidly cooling the hot rolled steel sheet right after the end of hot rolling, the {111}<110> which is slow to recover during annealing due to the dissolved Ti and fast to form recrystallization nuclei recrystallizes first, the recrystallized {111}<110> corrodes the surrounding nonrecovered {111}<112>, and the recrystallized {111}<110> expands in area. Here, there is a large difference in dislocation density between <110> and <112>, therefore the speed of expansion of the area of the recrystallized {111}<110> is fast and the percentage of the <110> is small (that is, there are few recrystallization nuclei), therefore expansion of the area of the recrystallized {111}<110> causes the crystal grains to coarsen. At the base steel sheet after annealing, coarse {111}<110> account for much of it. In particular, if a predetermined amount or more of Ti is added aiming at pinning the C in the base steel sheet, dissolved Ti easily stays present at the hot rolled steel sheet. If not performing the above rapid cooling, the crystal grains easily coarsen due to the dissolved Ti. Further, if the cooling conditions after the end of the hot finish rolling are not suitably controlled, the amount of C segregating at the grain boundaries becomes difficult to reduce by Ti etc. and the relationship of the formula (4) becomes difficult to satisfy. As a result, at the time of alloying of the plating, it becomes difficult for the Fe to diffuse from the base steel sheet to the plating layer, the alloying speed falls, and the nonalloyed plating at the alloyed hot-dip galvanized steel sheet becomes greater. For this reason, sticking of the nonalloyed plating to the dies at the time of press working easily occurs and the shapeability at the time of press working and the productivity easily fall.

As opposed to this, if rapidly cooling hot rolled steel sheet right after the end of hot rolling like in the method of production according to the present embodiment, the slow recovery due to annealing can be resolved. That is, {111}<110> recrystallizes first, but the surrounding {111}<112> recovers and the difference in dislocation density between <110> and <112> does not become large, therefore the recrystallized {111}<110> hardly expands in area. The large number of subgrains formed along with recovery function as nuclei, therefore {111}<112> also recrystallizes after a delay. As a result, there are a large number of recrystallized nuclei, the crystal grains become finer, and fine {111}<112> end up accounting for much of the area after annealing. Further, by the cooling conditions after the end of the hot finish rolling being suitably controlled, the relationship of formula (4) becomes easily solved and the shapeability after press working and the productivity are easily improved.

The mechanism behind promotion of recovery at the initial stage of annealing due to rapid cooling is believed to be as follows. That is, in the structure of the base steel sheet, the drive force behind formation of nuclei increases due to rapid cooling, the precipitation nuclei increase, and further the nuclei grow due to the later explained coiling, therefore precipitation of Ti is promoted and the amount of dissolved Ti is reduced. As a result, it is guessed that delay in recovery due to Ti—C composites hardly ever occurs. Alternatively, bainitic ferrite having substructures are formed and the boundaries of the substructures become sites for formation of precipitation nuclei, therefore precipitation of Ti is promoted and the amount of dissolved Ti is reduced. As a result, it is guessed, delay in recovery due to Ti—C composites hardly ever occurs. Alternatively, it is guessed, the substructures of the bainitic ferrite change the cold rolled structures and increase the recrystallization nuclei.

2.2. Slow Cooling After Rapid Cooling

In the present embodiment, the hot rolled steel sheet starts to be cooled (rapidly cooled) within 0.5 second after the end of finish rolling of the hot rolling by a cooling speed of 15° C./s or more. After that, as explained above, the hot rolled steel sheet is rapidly cooled down to the rapid cooling stop temperature of 600° C. or more and 700° C. or less, then the hot rolled steel sheet is slow cooled down to the coiling temperature of 150° C. or less by cooling speed of 5.0° C./s or less. If slow cooling the hot rolled steel sheet down to the coiling temperature after rapidly cooling it in this way, as explained above, coarsening of the crystal grains recrystallized early is suppressed and recrystallization nuclei increase, therefore the crystal grains can be made finer.

2.3. Coiling Temperature

In the present embodiment, after the hot rolled steel sheet is rapidly cooled and slow cooled as explained above, it is coiled at a temperature of 150° C. or less. Due to the coiling temperature being 150° C. or less, it is guessed, coherent precipitates are utilized and fine strong precipitates are formed in large amounts at the annealing. As a result, the mechanical properties etc. of the steel sheet are improved.

2.4. Other Steps

In the method of production according to the present embodiment, as explained above, hot rolling, rapid cooling right after the end of hot finish rolling and the subsequent slow cooling, coiling at a predetermined temperature, and the subsequent cold rolling and annealing are performed. The thus obtained base steel sheet is provided with an alloyed hot-dip galvanized layer, whereby the desired alloyed hot-dip galvanized steel sheet is obtained. The hot rolling conditions, cold rolling conditions, annealing conditions, and plating conditions are not particularly limited. Below, an example of the steps will be shown.

(Heating Temperature of Slab Before Hot Rolling and Finish Rolling Temperature of Hot Rolling)

The heating temperature of the slab before hot rolling (extraction temperature) used may be a general temperature. The extraction temperature may, for example, be 1200 to 1300° C. Further, in hot rolling the heated slab, the rough rolling conditions in the hot rolling used may be general conditions. The finish rolling conditions of the hot rolling used may also be general conditions. However, the finish rolling temperature of the hot rolling is a factor having an effect on control of the texture of the base steel sheet, therefore it is sufficient to control it to a predetermined temperature range. For example, the finish rolling temperature of the hot rolling may be 900° C. or more and 950° C. or less.

(Rolling Reduction at Cold Rolling)

The rolling reduction at the cold rolling is important from the viewpoint of obtaining a texture excellent in r-value. For example, the total of the rolling reduction in the cold rolling is preferably 70% or more. The annealing may be performed at a 700° C. or less for the purpose of reducing the cooling load before the cold rolling.

(Annealing Atmosphere)

The annealing may be performed in a high dew point atmosphere and may be performed in a low dew point atmosphere. For example, the dew point in the annealing atmosphere may be −60° C. or more and may be 20° C. or less.

(Annealing Holding Temperature)

If the heating temperature at the time of annealing is too low, the ductility of the steel sheet easily falls. On the other hand, excessively high temperature heating not only invites a rise in costs, but also results in inferior sheet shape at the time of high temperature sheet running or lower roll life and causes trouble. From the above viewpoint, the high temperature heating temperature at the time of annealing (annealing holding temperature) is preferably 750° C. or more and is preferably 900° C. or less.

(Annealing Holding Time)

At the time of annealing, it is preferable to hold the steel sheet at the heating temperature for 5 seconds or more. If the holding time is too short, the drop in strength may be conspicuous. Further, the hardness easily greatly varies. From these viewpoints, the holding time is more preferably 10 seconds or more. More preferably, it is 20 seconds or more.

(Cooling Speed After Annealing)

The cooling conditions after the above annealing are not particularly limited.

(Cooling Stop Temperature and Reheating After Annealing)

Further, after cooling after annealing, if the cooling stop temperature is then lower than the plating bath temperature, the steel sheet may be reheated and made to dwell at the 350° C. to 600° C. temperature region. Further, if the cooling stop temperature is excessively low, not only is massive capital investment required, but also the effect becomes saturated.

(Dwell Temperature)

Furthermore, (after reheating) before dipping in the plating bath, the steel sheet may be made to dwell in the 350 to 600° C. temperature region. Dwelling at that temperature range suppresses unevenness of temperature in the width direction of the sheet and improves the appearance after plating. Further, if the cooling stop temperature after the annealing is 350° C. to 600° C., it is sufficient to perform dwelling without reheating.

(Dwell Time)

The dwell time is preferably 30 seconds or more and 300 seconds or less so as to obtain that effect.

(Tempering)

In the annealing step, the cold rolled steel sheet or the cold rolled steel sheet obtained by plating the steel sheet may be reheated after cooling it down to room temperature or in the middle of cooling down to room temperature (however, Ms or less).

(Plating)

The steel sheet may be heated or cooled to (galvanization bath temperature−40)° C. to (galvanization bath temperature+50)° C. and hot dip galvanized. Due to the hot dip galvanization step, the surface of the steel sheet is formed with a hot dip galvanized layer. For example, in the method of production according to the present embodiment, during the annealing, the surface of the sheet may be formed with a plating layer. Alternatively, the surface of the annealed steel sheet may be formed with that plating layer.

(Composition of Plating Bath)

The composition of the plating bath need only be one mainly comprised of Zn and enabling the chemical composition of the plating layer after alloying treatment to fall in the desired range. The composition of the plating bath is preferably one with an effective amount of Al (value of total amount of Al in the plating bath minus total amount of Fe) of 0.050 to 0.250 mass %. If the effective amount of Al in the plating bath is too small. Fe excessively penetrates the plating layer and the plating adhesion is liable to fall. On the other hand, if the effective amount of Al in the plating bath is too large. Al-based oxides obstructing movement of Fe atoms and Zn atoms are formed at the boundary of the steel sheet and plating layer and the plating adhesion is liable to fall.

(Steel Sheet Temperature at Time of Dipping in Plating Bath)

The temperature of the steel sheet when dipped in the plating bath is preferably from a temperature 40° C. lower than the hot dip galvanization bath temperature (hot dip galvanization bath temperature−40° C.) to a temperature 50° C. higher than the hot dip galvanization bath temperature (hot dip galvanization bath temperature+50° C.). If the temperature falls below the hot dip galvanization bath temperature−40° C. the heat removed when being dipped in the plating bath becomes large and part of the molten zinc may end up solidifying and the plating appearance may be degraded. If the sheet temperature before dipping falls below the hot dip galvanization bath temperature−40° C. the steel sheet may be further heated by any method before dipping in the plating bath to control the sheet temperature to the hot dip galvanization bath temperature−40° C. or more, then dipped in the plating bath. Further, if the sheet temperature at the time of dipping in the plating bath exceeds the hot dip galvanization bath temperature+50° C. problems in operation may be induced along with the rise in the plating bath temperature.

(Steel Sheet Temperature after Entry into Plating Bath)

To alloy the hot dip galvanization layer, the steel sheet formed with the hot dip galvanization layer may be heated to 450 to 600° C. in temperature range. If the alloying temperature is too low, the alloying is liable to not sufficiently proceed. On the other hand, if the alloying temperature is too high, the alloying is liable to proceed too far and a Γ phase will be formed resulting in the Fe content in the plating layer becoming excessive and corrosion resistance deteriorating. The alloying temperature has to be changed according to the chemical composition of the steel sheet and the degree of formation of the internal oxidation layer. It should be set while checking the Fe content in the plating layer. The hot dip galvanization layer is, for example, performed in an alloying furnace and temperature holding zone. The dwell time in the alloying furnace and temperature holding zone may be, for example, about 10 seconds at the alloying furnace and about 20 seconds at the soaking zone for a total of about 30 seconds. Further, the "temperature holding zone" is a section where heat is held so that the temperature of the steel sheet exiting from the alloying furnace does not rapidly fall.

(Post-Treatment)

The surface of the alloyed hot-dip galvanized steel sheet can be improved in paintability and weldability by applying a top plating and by performing various treatment, for example, chromate treatment, phosphate treatment, treatment for improving the lubrication ability, treatment for improving the weldability, etc.

(Skin Pass Rolling Rate)

Further, the steel sheet may also be rolled by a skin pass for the purpose of correcting the shape of the steel sheet or improving the ductility by introducing movable dislocations. The rolling reduction of the skin pass rolling after heat treatment is preferably 0.1 to 1.5% in range. If less than 0.1%, the effect is small and control is difficult, therefore this becomes the lower limit. If more than 1.5%, the productivity remarkably falls, therefore this is the upper limit. The skin pass may be performed in-line and may be performed off-line. Further, a single skin pass of the target rolling reduction may be performed or the skin pass may be performed divided into several passes.

EXAMPLES

Below, examples according to the present invention will be shown. The present invention is not limited to these sets of conditions. The present invention can employ various conditions so long as not departing from its gist and achieving its object.

1. Preparation of Base Steel Sheet

Steels having various chemical compositions were smelted to produce steel slabs. These steel slabs were inserted into a furnace heated to 1250° C. and held for 60 minutes as homogenization, then were taken out into the atmosphere and hot rolled to obtain thickness 3.2 mm steel sheets. The end temperature of the finish rolling of the hot rolling was 920° C. Further, after the end of the finish rolling, the steel sheets started to be cooled at the point of the elapsed time shown in the following Tables 3, 6, and 9. The steel sheets were cooled by the cooling speeds shown in the following Tables 3, 6, and 9 (time of rapid cooling) down to a predetermined rapid cooling stop temperature, then were cooled by the cooling speeds shown in the following Tables 3, 6, and 9 (time of slow cooling) down to a predetermined coiling temperature, then were coiled at that coiling temperature. Next, the oxide scales of the hot rolled steel sheets were removed by pickling then the steel sheets were cold rolled (rolling reduction 75%) and the sheet thicknesses finished to 0.8 mm. Further, the cold rolled steel sheets were annealed. Specifically, the steel sheets were raised in temperature up to the annealing temperatures shown in the following Tables 3, 6, and 9. The holding times at those temperatures were 80 seconds. In all of the steel sheets, the speed of temperature rise at the time of annealing was 10° C./s up to 700° C. and 5° C./s from 700° C. to the holding temperature. The atmosphere during the holding was $N_2$-4% $H_2$ and the dew point was −50° C. After the annealing, the steel sheets were plated and annealed immediately according to the later explained methods, then were rolled by a skin pass. The chemical compositions of the base steel sheets obtained by analyzing samples taken from the obtained steel sheets are as shown in the following Tables 1, 2, 4, 5, 7, and 8. Note that the balances other than the constituents shown in Tables 1, 2, 4, 5, 7, and 8 are Fe and impurities. Further, in Tables 1, 2, 4, 5, 7, and 8, the "value of formula (1)", "value of formula (2)" and "value of formula (3)" are values defined as follows:

$$\text{(Value of formula (1))} = 100[\text{Si}]+40[\text{Mn}]+900[\text{P}]$$

$$\text{(Value of formula (2))} = 100[\text{Si}]+40[\text{Mn}]+900[\text{P}]$$

$$\text{(Value of formula (3))} = 15(2[\text{C}] - ([\text{Ti}] - 4[\text{N}])/3 - [\text{Nb}]/8) + 7[\text{P}] + [\text{Si}] + 20[\text{B}]$$

2. Plating

The steel sheets were hot dip galvanized, then alloyed. In the hot dip galvanization step, the steel sheets were dipped in a 450° C. hot dip galvanization bath for 5 seconds. After that, they were alloyed at 590° C. The cooling speed from the alloying temperature to room temperature was made 10° C./s for cooling to obtain the alloyed hot-dip galvanized steel sheets. Further, the base steel sheets can be plated by the same equipment and line as the annealing.

3. Evaluation 3.1. Properties of Base Steel Sheet 3.1.1. Analysis of Extraction Residue The constituents in the extraction residue obtained by analysis of the extraction residue were analyzed and it was confirmed whether the constituents contained in the base steel sheet satisfied ("Yes") or were not satisfied ("No") the following formula (4). The analysis of the extraction residue was as explained above.

$$[\text{C}]/12 \leq [X_{Ti}]/48 + [X_{Nb}]/93 \leq [\text{C}]/12 + [\text{N}]/14 + [X_P]/31 - ([X_S]/32 - [X_{Mn}]/55) \quad (4)$$

3.1.2. Measurement of Average Grain Diameter of Base Steel Sheet

The average grain diameter of the crystal grains forming the base steel sheet was measured. The method of measurement of the average grain diameter was as explained above.

3.2. Mechanical Properties

The yield point (YP), tensile strength (TS), and total elongation (EL) of the alloyed hot-dip galvanized steel sheet were measured. The measurement conditions were as explained above.

3.3. Plateability 3.3.1. Wettability

The wettability of the plating at the time of plating the base steel sheet was evaluated by the following criteria.

Good: good wettability (in visual examination, 100% of surface of base steel sheet observed to be plated)

Poor: poor wettability (in visual examination, parts of surface of base steel sheet observed to be not plated)

3.3.2. Presence of Formation of Streaks

The appearance of the alloyed hot-dip galvanized steel sheet was visually examined and the presence of formation of plating streaks was evaluated. The case where clear plating streaks were not confirmed if viewed from a position 0.5 meter from the steel sheet was evaluated as "Good" while the case where clear plating streaks were confirmed was evaluated as "Poor".

3.4. Shapeability and Workability 3.4.1. Presence of Plating Sticking at Dies

The alloyed hot-dip galvanized steel sheet was press worked (conditions: cylindrical deep drawing) and evaluated for the presence of plating sticking at the dies by the following criteria:

Good: almost no plating sticking at the dies

Poor: large amount of plating sticking at the dies 3.4.2. Secondary Work Embrittlement The alloyed hot-dip galvanized steel sheet was deep drawn into a cylinder and cooled at 0° C. for 5 minutes or more. This was crushed by a press and evaluated for the presence of secondary work embrittlement by the following criteria:

Good: no secondary work embrittlement (crack length after pressing of less than 10 mm)

Poor: secondary work embrittlement (crack length after pressing of 10 mm or more)

4. Results

The following Tables 1, 2, 4, 5, 7, and 8 show the chemical composition of the base steel sheet. Further, the following Tables 3, 6, and 9 show the manufacturing conditions of the base steel sheet, the base steel sheet properties, mechanical properties, and results of evaluation of the plateability and the shapeability and workability.

TABLE 1

| | Constituents (%) | | | | | | | | | | | | | |
|---|---|---|---|---|---|---|---|---|---|---|---|---|---|---|
| No. | C | Si | Mn | P | S | Nb | Ti | B | Al | N | Cu | Cr | Ni | Mo |
| 1 | 0.0140 | 0.31 | 1.13 | 0.072 | 0.009 | 0.021 | 0.100 | 0.0009 | 0.124 | 0.0022 | — | — | — | — |
| 2 | 0.0150 | 0.31 | 1.13 | 0.072 | 0.001 | 0.021 | 0.100 | 0.0009 | 0.361 | 0.0022 | — | — | — | — |
| 3 | 0.0033 | 0.60 | 1.14 | 0.040 | 0.010 | 0.020 | 0.028 | 0.0010 | 0.663 | 0.0022 | — | — | — | — |
| 4 | 0.0030 | 0.70 | 1.15 | 0.038 | 0.004 | 0.020 | 0.030 | 0.0010 | 0.785 | 0.0020 | — | — | — | — |
| 5 | 0.0022 | 0.34 | 1.53 | 0.039 | 0.001 | 0.020 | 0.019 | 0.0010 | 0.816 | 0.0018 | — | — | — | — |
| 6 | 0.0023 | 0.30 | 1.34 | 0.052 | 0.000 | 0.021 | 0.031 | 0.0010 | 0.138 | 0.0024 | — | — | — | — |
| 7 | 0.0023 | 0.30 | 1.15 | 0.125 | 0.006 | 0.021 | 0.100 | 0.0010 | 0.521 | 0.0024 | — | — | — | — |
| 8 | 0.0031 | 0.29 | 1.16 | 0.070 | 0.015 | 0.020 | 0.033 | 0.0010 | 0.353 | 0.0038 | — | — | — | — |
| 9 | 0.0030 | 0.28 | 1.14 | 0.070 | 0.012 | 0.021 | 0.033 | 0.0012 | 0.936 | 0.0034 | — | — | — | — |
| 10 | 0.0021 | 0.30 | 1.16 | 0.072 | 0.009 | 0.021 | 0.100 | 0.0002 | 0.308 | 0.0023 | — | — | — | — |
| 11 | 0.0018 | 0.31 | 1.15 | 0.071 | 0.006 | 0.006 | 0.100 | 0.0004 | 0.435 | 0.0020 | — | — | — | — |
| 12 | 0.0033 | 0.30 | 1.15 | 0.070 | 0.007 | 0.020 | 0.030 | 0.0120 | 0.577 | 0.0040 | — | — | — | — |
| 13 | 0.0033 | 0.01 | 1.15 | 0.070 | 0.002 | 0.020 | 0.100 | 0.0030 | 0.840 | 0.0040 | — | — | — | — |

TABLE 1-continued

| No. | Constituents (%) C | Si | Mn | P | S | Nb | Ti | B | Al | N | Cu | Cr | Ni | Mo |
|---|---|---|---|---|---|---|---|---|---|---|---|---|---|---|
| 14 | 0.0022 | 0.30 | 1.16 | 0.072 | 0.005 | 0.021 | 0.100 | 0.0074 | 0.212 | 0.0114 | — | — | — | — |
| 15 | 0.0052 | 0.30 | 1.16 | 0.072 | 0.009 | 0.021 | 0.100 | 0.0018 | 0.855 | 0.0020 | — | — | — | — |
| 16 | 0.0086 | 0.30 | 1.16 | 0.072 | 0.006 | 0.021 | 0.100 | 0.0010 | 0.969 | 0.0015 | — | — | — | — |
| 17 | 0.0096 | 0.30 | 1.16 | 0.072 | 0.009 | 0.021 | 0.100 | 0.0018 | 0.392 | 0.0050 | — | — | — | — |
| 18 | 0.0077 | 0.30 | 1.16 | 0.072 | 0.004 | 0.021 | 0.100 | 0.0078 | 0.961 | 0.0032 | — | — | — | — |
| 19 | 0.0047 | 0.31 | 1.14 | 0.073 | 0.007 | — | 0.085 | 0.0026 | 0.746 | 0.0080 | — | — | — | — |
| 20 | 0.0067 | 0.02 | 1.29 | 0.100 | 0.003 | 0.021 | 0.085 | 0.0095 | 0.243 | 0.0050 | — | — | — | — |
| 21 | 0.0016 | 0.50 | 0.20 | 0.080 | 0.005 | 0.021 | 0.085 | 0.0020 | 0.178 | 0.0020 | — | — | — | — |
| 22 | 0.0087 | 0.50 | 1.30 | 0.032 | 0.006 | — | 0.085 | 0.0025 | 0.440 | 0.0030 | — | — | — | — |
| 23 | 0.0020 | 0.40 | 0.90 | 0.090 | 0.003 | 0.090 | 0.060 | 0.0025 | 0.189 | 0.0020 | — | — | — | — |
| 24 | 0.0042 | 0.35 | 1.20 | 0.080 | 0.000 | — | 0.080 | 0.0011 | 0.135 | 0.0040 | — | — | — | — |
| 25 | 0.0023 | 0.35 | 1.20 | 0.080 | 0.007 | — | 0.080 | 0.0013 | 0.191 | 0.0062 | — | — | — | — |

TABLE 2

| No. | Constituents (%) W | V | O | Ta | Co | Sn | Sb | As | Mg | Zr | Ca | REM | Value of formula (1) | Value of formula (3) |
|---|---|---|---|---|---|---|---|---|---|---|---|---|---|---|
| 1 | — | — | — | — | — | — | — | — | — | — | — | — | 141 | 0.76 |
| 2 | — | — | — | — | — | — | — | — | — | — | — | — | 141 | 0.79 |
| 3 | — | — | — | — | — | — | — | — | — | — | — | — | 142 | 0.87 |
| 4 | — | — | — | — | — | — | — | — | — | — | — | — | 150 | 0.93 |
| 5 | — | — | — | — | — | — | — | — | — | — | — | — | 130 | 0.60 |
| 6 | — | — | — | — | — | — | — | — | — | — | — | — | 130 | 0.61 |
| 7 | — | — | — | — | — | — | — | — | — | — | — | — | 189 | 0.77 |
| 8 | — | — | — | — | — | — | — | — | — | — | — | — | 138 | 0.77 |
| 9 | — | — | — | — | — | — | — | — | — | — | — | — | 137 | 0.75 |
| 10 | — | — | — | — | — | — | — | — | — | — | — | — | 141 | 0.38 |
| 11 | — | — | — | — | — | — | — | — | — | — | — | — | 141 | 0.40 |
| 12 | — | — | — | — | — | — | — | — | — | — | — | — | 139 | 1.02 |
| 13 | — | — | — | — | — | — | — | — | — | — | — | — | 110 | 0.20 |
| 14 | — | — | — | — | — | — | — | — | — | — | — | — | 141 | 0.71 |
| 15 | — | — | — | — | — | — | — | — | — | — | — | — | 141 | 0.50 |
| 16 | — | — | — | — | — | — | — | — | — | — | — | — | 141 | 0.57 |
| 17 | — | — | — | — | — | — | — | — | — | — | — | — | 141 | 0.69 |
| 18 | — | — | — | — | — | — | — | — | — | — | — | — | 141 | 0.72 |
| 19 | — | — | — | — | — | — | — | — | — | — | — | — | 142 | 0.75 |
| 20 | — | — | — | — | — | — | — | — | — | — | — | — | 144 | 0.75 |
| 21 | — | — | — | — | — | — | — | — | — | — | — | — | 130 | 0.72 |
| 22 | — | — | — | — | — | — | — | — | — | — | — | — | 131 | 0.67 |
| 23 | — | — | — | — | — | — | — | — | — | — | — | — | 157 | 0.71 |
| 24 | — | — | — | — | — | — | — | — | — | — | — | — | 155 | 0.74 |
| 25 | — | — | — | — | — | — | — | — | — | — | — | — | 155 | 0.73 |

TABLE 3

| No. | Manufacturing conditions Extraction temp. [° C.] | Finish temp. [° C.] | Time after end of finish rolling until start of cooling [s] | Cooling speed (at rapid cooling) [° C./s] | Rapid cooling stop temp. [° C.] | Cooling speed (at slow cooling) [° C./s] | Coiling temp. [° C.] | Annealing temp. [° C.] | Base steel sheet properties Formula (4) satisfied? |
|---|---|---|---|---|---|---|---|---|---|
| 1 | 1250 | 920 | 0.3 | 20 | 680 | 4.0 | 120 | 790 | Yes |
| 2 | 1250 | 920 | 0.3 | 20 | 691 | 4.0 | 130 | 840 | Yes |
| 3 | 1250 | 920 | 0.3 | 20 | 695 | 4.0 | 120 | 790 | Yes |
| 4 | 1250 | 920 | 0.3 | 20 | 685 | 4.0 | 130 | 840 | Yes |
| 5 | 1250 | 920 | 0.3 | 20 | 688 | 4.0 | 120 | 790 | Yes |
| 6 | 1250 | 920 | 0.3 | 20 | 694 | 4.0 | 140 | 790 | Yes |
| 7 | 1250 | 920 | 0.3 | 20 | 679 | 4.0 | 120 | 790 | Yes |
| 8 | 1250 | 920 | 0.3 | 20 | 699 | 4.0 | 130 | 790 | Yes |
| 9 | 1250 | 920 | 0.3 | 20 | 696 | 4.0 | 130 | 790 | Yes |
| 10 | 1250 | 920 | 0.3 | 20 | 686 | 4.0 | 140 | 790 | Yes |
| 11 | 1250 | 920 | 0.3 | 20 | 693 | 4.0 | 120 | 790 | Yes |

TABLE 3-continued

| | | | | | | | | | |
|---|---|---|---|---|---|---|---|---|---|
| 12 | 1250 | 920 | 0.3 | 20 | 691 | 4.0 | 120 | 790 | Yes |
| 13 | 1250 | 920 | 0.3 | 20 | 698 | 4.0 | 140 | 790 | Yes |
| 14 | 1250 | 920 | 1 | 20 | 695 | 4.0 | 130 | 790 | No |
| 15 | 1250 | 920 | 0.3 | 5 | 684 | 4.0 | 130 | 840 | No |
| 16 | 1250 | 920 | 0.3 | 20 | 688 | 8.0 | 120 | 840 | No |
| 17 | 1250 | 920 | 0.3 | 20 | 795 | 4.0 | 120 | 790 | No |
| 18 | 1250 | 920 | 0.3 | 20 | 603 | 4.0 | 280 | 790 | No |
| 19 | 1250 | 920 | 0.3 | 20 | 697 | 4.0 | 120 | 790 | Yes |
| 20 | 1250 | 920 | 0.3 | 20 | 692 | 4.0 | 140 | 790 | Yes |
| 21 | 1250 | 920 | 0.3 | 20 | 689 | 4.0 | 130 | 790 | Yes |
| 22 | 1250 | 920 | 0.3 | 20 | 692 | 4.0 | 120 | 790 | Yes |
| 23 | 1250 | 920 | 0.3 | 20 | 694 | 4.0 | 140 | 790 | Yes |
| 24 | 1250 | 920 | 0.3 | 20 | 688 | 4.0 | 120 | 790 | Yes |
| 25 | 1250 | 920 | 0.3 | 20 | 697 | 4.0 | 120 | 790 | Yes |

| | Base steel sheet properties Average grain size | Mechanical properties | | | Plating and appearance | | Shapeability and workability | | |
|---|---|---|---|---|---|---|---|---|---|
| No. | [μm] | YP | TS | EL | Wettability | Streaks | Presence of plating sticking at dies (No: Good, Yes: Poor) | Secondary work embrittlement | Remarks |
| 1 | 5.6 | 263 | 470 | 24 | Good | Good | Poor | Good | Comp. ex. |
| 2 | 5.1 | 309 | 451 | 38 | Good | Good | Poor | Good | Comp. ex. |
| 3 | 5.7 | 280 | 447 | 36 | Poor | Good | Poor | Good | Comp. ex. |
| 4 | 5.4 | 300 | 460 | 38 | Poor | Good | Poor | Good | Comp. ex. |
| 5 | 5.6 | 294 | 447 | 37 | Good | Poor | Good | Good | Comp. ex. |
| 6 | 5.7 | 283 | 445 | 36 | Good | Poor | Good | Good | Comp. ex. |
| 7 | 6.0 | 240 | 480 | 25 | Good | Good | Poor | Good | Comp. ex. |
| 8 | 5.3 | 289 | 455 | 36 | Good | Good | Poor | Poor | Comp. ex. |
| 9 | 5.1 | 283 | 457 | 36 | Good | Good | Good | Poor | Comp. ex. |
| 10 | 5.5 | 240 | 461 | 30 | Good | Good | Good | Poor | Comp. ex. |
| 11 | 5.8 | 233 | 454 | 29 | Good | Good | Good | Poor | Comp. ex. |
| 12 | 5.6 | 300 | 462 | 34 | Good | Good | Poor | Good | Comp. ex. |
| 13 | 5.6 | 271 | 428 | 36 | Good | Good | Good | Good | Comp. ex. |
| 14 | 9.5 | 198 | 462 | 29 | Good | Good | Poor | Good | Comp. ex. |
| 15 | 11.0 | 189 | 436 | 31 | Good | Good | Poor | Good | Comp. ex. |
| 16 | 11.0 | 232 | 438 | 26 | Good | Good | Poor | Good | Comp. ex. |
| 17 | 12.0 | 191 | 453 | 29 | Good | Good | Poor | Good | Comp. ex. |
| 18 | 10.5 | 242 | 433 | 25 | Good | Good | Poor | Good | Comp.ex.omp. ex |
| 19 | 6.1 | 246 | 456 | 32 | Good | Good | Good | Good | Ex. |
| 20 | 6.0 | 248 | 458 | 32 | Good | Good | Good | Good | Ex. |
| 21 | 5.9 | 230 | 443 | 34 | Good | Good | Good | Good | Ex. |
| 22 | 6.5 | 235 | 444 | 34 | Good | Good | Good | Good | Ex. |
| 23 | 6.4 | 235 | 444 | 34 | Good | Good | Good | Good | Ex. |
| 24 | 5.3 | 230 | 442 | 34 | Good | Good | Good | Good | Ex. |
| 25 | 6.9 | 233 | 443 | 34 | Good | Good | Good | Good | Ex. |

TABLE 4

| | Constituents (%) | | | | | | | | | | | | | |
|---|---|---|---|---|---|---|---|---|---|---|---|---|---|---|
| No. | C | Si | Mn | P | S | Nb | Ti | B | Al | N | Cu | Cr | Ni | Mo |
| 26 | 0.0080 | 0.38 | 1.25 | 0.048 | 0.003 | — | 0.085 | 0.0041 | 0.184 | 0.0006 | — | — | — | — |
| 27 | 0.0030 | 0.16 | 0.85 | 0.090 | 0.007 | 0.067 | 0.045 | 0.0030 | 0.543 | 0.0020 | — | — | — | — |
| 28 | 0.0040 | 0.39 | 0.92 | 0.060 | 0.008 | 0.056 | 0.045 | 0.0019 | 0.607 | 0.0020 | — | — | — | — |
| 29 | 0.0020 | 0.34 | 0.91 | 0.068 | 0.002 | — | 0.045 | 0.0005 | 0.176 | 0.0020 | — | — | — | — |
| 30 | 0.0030 | 0.12 | 0.80 | 0.100 | 0.006 | — | 0.045 | 0.0010 | 0.472 | 0.0020 | — | — | — | — |
| 31 | 0.0026 | 0.25 | 0.90 | 0.080 | 0.008 | — | 0.045 | 0.0020 | 0.449 | 0.0020 | — | — | — | — |
| 32 | 0.0007 | 0.41 | 1.00 | 0.060 | 0.010 | 0.088 | 0.045 | 0.0036 | 0.229 | 0.0030 | — | — | — | — |
| 33 | 0.0020 | 0.36 | 1.16 | 0.055 | 0.009 | — | 0.100 | 0.0056 | 0.087 | 0.0057 | — | — | — | — |
| 34 | 0.0079 | 0.20 | 0.79 | 0.087 | 0.008 | — | 0.100 | 0.0041 | 0.597 | 0.0030 | — | — | — | — |
| 35 | 0.0029 | 0.10 | 1.08 | 0.090 | 0.000 | 0.075 | 0.100 | 0.0088 | 0.398 | 0.0050 | 0.852 | — | — | — |
| 36 | 0.0092 | 0.21 | 1.03 | 0.076 | 0.006 | 0.081 | 0.100 | 0.0031 | 0.667 | 0.0040 | — | 0.455 | — | — |
| 37 | 0.0055 | 0.04 | 1.00 | 0.100 | 0.000 | 0.094 | 0.100 | 0.0075 | 0.767 | 0.0050 | — | — | 0.492 | — |
| 38 | 0.0020 | 0.46 | 0.57 | 0.073 | 0.000 | 0.041 | 0.090 | 0.0062 | 0.978 | 0.0020 | — | — | — | 0.830 |
| 39 | 0.0051 | 0.18 | 1.16 | 0.077 | 0.004 | 0.088 | 0.053 | 0.0010 | 0.144 | 0.0020 | — | — | — | — |

TABLE 4-continued

| No. | Constituents (%) | | | | | | | | | | | | | |
|---|---|---|---|---|---|---|---|---|---|---|---|---|---|---|
| | C | Si | Mn | P | S | Nb | Ti | B | Al | N | Cu | Cr | Ni | Mo |
| 40 | 0.0057 | 0.47 | 1.23 | 0.040 | 0.001 | 0.090 | 0.053 | 0.0005 | 0.239 | 0.0020 | — | — | — | — |
| 41 | 0.0025 | 0.17 | 1.00 | 0.086 | 0.009 | 0.023 | 0.053 | 0.0021 | 0.378 | 0.0040 | — | — | — | — |
| 42 | 0.0034 | 0.05 | 1.00 | 0.100 | 0.007 | 0.095 | 0.053 | 0.0009 | 0.329 | 0.0030 | — | — | — | — |
| 43 | 0.0030 | 0.29 | 0.42 | 0.096 | 0.010 | 0.003 | 0.090 | 0.0010 | 0.048 | 0.0020 | — | — | — | — |
| 44 | 0.0040 | 0.21 | 0.84 | 0.089 | 0.009 | 0.029 | 0.053 | 0.0010 | 0.346 | 0.0020 | — | — | — | — |
| 45 | 0.0030 | 0.30 | 0.47 | 0.091 | 0.008 | 0.027 | 0.080 | 0.0010 | 0.581 | 0.0020 | — | — | — | — |
| 46 | 0.0040 | 0.12 | 1.09 | 0.086 | 0.008 | 0.037 | 0.053 | 0.0028 | 0.710 | 0.0030 | — | — | — | — |
| 47 | 0.0011 | 0.20 | 0.50 | 0.100 | 0.008 | 0.081 | 0.053 | 0.0008 | 0.266 | 0.0032 | — | — | — | — |
| 48 | 0.0020 | 0.10 | 1.25 | 0.082 | 0.004 | 0.036 | 0.053 | 0.0054 | 0.181 | 0.0030 | — | — | — | — |
| 49 | 0.0047 | 0.44 | 1.25 | 0.044 | 0.002 | 0.013 | 0.053 | 0.0019 | 0.942 | 0.0020 | — | — | — | — |
| 50 | 0.0053 | 0.14 | 1.21 | 0.078 | 0.009 | 0.084 | 0.053 | 0.0010 | 0.310 | 0.0020 | — | — | — | — |

TABLE 5

| No. | Constituents (%) | | | | | | | | | | | | Value of formula (1) | Value of formula (3) |
|---|---|---|---|---|---|---|---|---|---|---|---|---|---|---|
| | W | V | O | Ta | Co | Sn | Sb | As | Mg | Zr | Ca | REM | | |
| 26 | — | — | — | — | — | — | — | — | — | — | — | — | 131 | 0.62 |
| 27 | — | — | — | — | — | — | — | — | — | — | — | — | 131 | 0.63 |
| 28 | — | — | — | — | — | — | — | — | — | — | — | — | 130 | 0.68 |
| 29 | — | — | — | — | — | — | — | — | — | — | — | — | 132 | 0.70 |
| 30 | — | — | — | — | — | — | — | — | — | — | — | — | 134 | 0.75 |
| 31 | — | — | — | — | — | — | — | — | — | — | — | — | 133 | 0.74 |
| 32 | — | — | — | — | — | — | — | — | — | — | — | — | 135 | 0.59 |
| 33 | — | — | — | — | — | — | — | — | — | — | — | — | 132 | 0.53 |
| 34 | — | — | — | — | — | — | — | — | — | — | — | — | 130 | 0.69 |
| 35 | — | — | — | — | — | — | — | — | — | — | — | — | 134 | 0.45 |
| 36 | — | — | — | — | — | — | — | — | — | — | — | — | 130 | 0.51 |
| 37 | — | — | — | — | — | — | — | — | — | — | — | — | 134 | 0.48 |
| 38 | — | — | — | — | — | — | — | — | — | — | — | — | 135 | 0.67 |
| 39 | 0.091 | — | — | — | — | — | — | — | — | — | — | — | 134 | 0.50 |
| 40 | — | 0.892 | — | — | — | — | — | — | — | — | — | — | 132 | 0.54 |
| 41 | — | — | 0.018 | — | — | — | — | — | — | — | — | — | 134 | 0.65 |
| 42 | — | — | — | 0.082 | — | — | — | — | — | — | — | — | 135 | 0.48 |
| 43 | — | — | — | — | 0.570 | — | — | — | — | — | — | — | 133 | 0.66 |
| 44 | — | — | — | — | — | 0.640 | — | — | — | — | — | — | 134 | 0.69 |
| 45 | — | — | — | — | — | — | 0.420 | — | — | — | — | — | 131 | 0.64 |
| 46 | — | — | — | — | — | — | — | 0.030 | — | — | — | — | 132 | 0.62 |
| 47 | — | — | — | — | — | — | — | — | 0.023 | — | — | — | 130 | 0.60 |
| 48 | — | — | — | — | — | — | — | — | — | 0.049 | — | — | 133 | 0.57 |
| 49 | — | — | — | — | — | — | — | — | — | — | 0.0488 | — | 134 | 0.68 |
| 50 | — | — | — | — | — | — | — | — | — | — | — | 0.0492 | 133 | 0.48 |

TABLE 6

| No. | Manufacturing conditions | | | | | | | | |
|---|---|---|---|---|---|---|---|---|---|
| | Extraction temp. [° C.] | Finish temp. [° C.] | Time after end of finish rolling until start of cooling [s] | Cooling speed (at rapid cooling) [° C./s] | Rapid cooling stop temp. [° C.] | Cooling speed (at slow cooling) [° C./s] | Coiling temp. [° C.] | Annealing temp. [° C.] | Base steel sheet properties Formula (4) satisfied? |
| 26 | 1250 | 920 | 0.3 | 20 | 692 | 4.0 | 120 | 790 | Yes |
| 27 | 1250 | 920 | 0.3 | 20 | 688 | 4.0 | 120 | 770 | Yes |
| 28 | 1250 | 920 | 0.3 | 20 | 696 | 4.0 | 140 | 790 | Yes |
| 29 | 1250 | 920 | 0.3 | 20 | 687 | 4.0 | 140 | 810 | Yes |
| 30 | 1250 | 920 | 0.3 | 20 | 695 | 4.0 | 120 | 790 | Yes |
| 31 | 1250 | 920 | 0.3 | 20 | 693 | 4.0 | 130 | 810 | Yes |
| 32 | 1250 | 920 | 0.3 | 20 | 686 | 4.0 | 120 | 830 | Yes |
| 33 | 1250 | 920 | 0.3 | 20 | 697 | 4.0 | 120 | 830 | Yes |
| 34 | 1250 | 920 | 0.3 | 20 | 692 | 4.0 | 130 | 790 | Yes |
| 35 | 1250 | 920 | 0.3 | 20 | 688 | 4.0 | 130 | 840 | Yes |
| 36 | 1250 | 920 | 0.3 | 20 | 690 | 4.0 | 120 | 790 | Yes |
| 37 | 1250 | 920 | 0.3 | 20 | 695 | 4.0 | 120 | 840 | Yes |

TABLE 6-continued

| | | | | | | | | | |
|---|---|---|---|---|---|---|---|---|---|
| 38 | 1250 | 920 | 0.3 | 20 | 689 | 4.0 | 120 | 790 | Yes |
| 39 | 1250 | 920 | 0.3 | 20 | 691 | 4.0 | 120 | 790 | Yes |
| 40 | 1250 | 920 | 0.3 | 20 | 700 | 4.0 | 120 | 790 | Yes |
| 41 | 1250 | 920 | 0.3 | 20 | 694 | 4.0 | 140 | 790 | Yes |
| 42 | 1250 | 920 | 0.3 | 20 | 683 | 4.0 | 130 | 790 | Yes |
| 43 | 1250 | 920 | 0.3 | 20 | 695 | 4.0 | 120 | 790 | Yes |
| 44 | 1250 | 920 | 0.3 | 20 | 699 | 4.0 | 120 | 790 | Yes |
| 45 | 1250 | 920 | 0.3 | 20 | 689 | 4.0 | 120 | 790 | Yes |
| 46 | 1250 | 920 | 0.3 | 20 | 698 | 4.0 | 140 | 790 | Yes |
| 47 | 1250 | 920 | 0.3 | 20 | 697 | 4.0 | 120 | 790 | Yes |
| 48 | 1250 | 920 | 0.3 | 20 | 693 | 4.0 | 120 | 790 | Yes |
| 49 | 1250 | 920 | 0.3 | 20 | 692 | 4.0 | 140 | 790 | Yes |
| 50 | 1250 | 920 | 0.3 | 20 | 689 | 4.0 | 120 | 790 | Yes |

| | Base steel sheet properties Average grain size | Mechanical properties | | | Plating and appearance | | Shapeability and workability | | |
|---|---|---|---|---|---|---|---|---|---|
| No. | [μm] | YP | TS | EL | Wettability | Streaks | Presence of plating sticking at dies (No: Good, Yes: Poor) | Secondary work embrittlement | Remarks |
| 26 | 6.1 | 310 | 475 | 34 | Good | Good | Good | Good | Ex. |
| 27 | 5.3 | 319 | 483 | 34 | Good | Good | Good | Good | Ex. |
| 28 | 6.5 | 305 | 472 | 34 | Good | Good | Good | Good | Ex. |
| 29 | 5.3 | 299 | 467 | 34 | Good | Good | Good | Good | Ex. |
| 30 | 6.8 | 309 | 476 | 34 | Good | Good | Good | Good | Ex. |
| 31 | 5.5 | 299 | 468 | 36 | Good | Good | Good | Good | Ex. |
| 32 | 6.2 | 294 | 463 | 35 | Good | Good | Good | Good | Ex. |
| 33 | 5.9 | 307 | 474 | 34 | Good | Good | Good | Good | Ex. |
| 34 | 5.5 | 241 | 462 | 30 | Good | Good | Good | Good | Ex. |
| 35 | 5.4 | 210 | 441 | 32 | Good | Good | Good | Good | Ex. |
| 36 | 5.3 | 237 | 453 | 29 | Good | Good | Good | Good | Ex. |
| 37 | 6.8 | 201 | 431 | 34 | Good | Good | Good | Good | Ex. |
| 38 | 5.2 | 215 | 460 | 34 | Good | Good | Good | Good | Ex. |
| 39 | 5.5 | 202 | 457 | 33 | Good | Good | Good | Good | Ex. |
| 40 | 6.7 | 216 | 447 | 33 | Good | Good | Good | Good | Ex. |
| 41 | 6.0 | 206 | 454 | 32 | Good | Good | Good | Good | Ex. |
| 42 | 6.2 | 235 | 448 | 32 | Good | Good | Good | Good | Ex. |
| 43 | 6.9 | 240 | 452 | 32 | Good | Good | Good | Good | Ex. |
| 44 | 5.5 | 236 | 458 | 32 | Good | Good | Good | Good | Ex. |
| 45 | 5.1 | 204 | 448 | 33 | Good | Good | Good | Good | Ex. |
| 46 | 6.5 | 207 | 448 | 32 | Good | Good | Good | Good | Ex. |
| 47 | 5.7 | 204 | 444 | 34 | Good | Good | Good | Good | Ex. |
| 48 | 5.6 | 228 | 456 | 33 | Good | Good | Good | Good | Ex. |
| 49 | 6.8 | 240 | 459 | 32 | Good | Good | Good | Good | Ex. |
| 50 | 6.7 | 200 | 452 | 32 | Good | Good | Good | Good | Ex. |

TABLE 7

| | Constituents (%) | | | | | | | | | | | | | |
|---|---|---|---|---|---|---|---|---|---|---|---|---|---|---|
| No. | C | Si | Mn | P | S | Nb | Ti | B | Al | N | Cu | Cr | Ni | Mo |
| 51 | 0.0052 | 0.70 | 1.95 | 0.080 | 0.001 | 0.020 | 0.050 | 0.0008 | 0.599 | 0.0018 | — | — | — | — |
| 52 | 0.0030 | 0.47 | 2.10 | 0.010 | 0.005 | 0.011 | 0.070 | 0.0010 | 0.993 | 0.0018 | — | — | — | — |
| 53 | 0.0027 | 0.12 | 1.90 | 0.135 | 0.006 | 0.020 | 0.100 | 0.0012 | 0.516 | 0.0018 | — | — | — | — |
| 54 | 0.0015 | 0.15 | 1.88 | 0.040 | 0.016 | 0.022 | 0.050 | 0.0015 | 0.385 | 0.0018 | — | — | — | — |
| 55 | 0.0030 | 0.45 | 1.72 | 0.033 | 0.004 | 0.018 | 0.058 | 0.0002 | 0.710 | 0.0018 | — | — | — | — |
| 56 | 0.0006 | 0.32 | 1.81 | 0.090 | 0.003 | 0.021 | 0.043 | 0.0120 | 0.916 | 0.0018 | — | — | — | — |
| 57 | 0.0092 | 0.22 | 1.90 | 0.022 | 0.002 | 0.022 | 0.030 | 0.0010 | 0.513 | 0.0018 | — | — | — | — |
| 58 | 0.0046 | 0.49 | 1.80 | 0.045 | 0.003 | 0.018 | 0.090 | 0.0013 | 0.349 | 0.0010 | — | — | — | — |
| 59 | 0.0020 | 0.38 | 1.84 | 0.068 | 0.008 | 0.010 | 0.050 | 0.0012 | 0.221 | 0.0020 | — | — | — | — |
| 60 | 0.0006 | 0.33 | 1.75 | 0.065 | 0.006 | 0.015 | 0.087 | 0.0022 | 0.713 | 0.0020 | — | — | — | — |
| 61 | 0.0030 | 0.15 | 1.82 | 0.087 | 0.004 | 0.020 | 0.076 | 0.0060 | 0.766 | 0.0025 | — | — | — | — |
| 62 | 0.0035 | 0.24 | 1.88 | 0.075 | 0.002 | 0.021 | 0.056 | 0.0030 | 0.228 | 0.0030 | — | — | — | — |
| 63 | 0.0030 | 0.39 | 1.92 | 0.056 | 0.002 | — | 0.078 | 0.0020 | 0.543 | 0.0020 | — | — | — | — |

TABLE 7-continued

| No. | Constituents (%) | | | | | | | | | | | | | |
|---|---|---|---|---|---|---|---|---|---|---|---|---|---|---|
| | C | Si | Mn | P | S | Nb | Ti | B | Al | N | Cu | Cr | Ni | Mo |
| 64 | 0.0020 | 0.41 | 1.98 | 0.046 | 0.003 | 0.010 | 0.090 | 0.0008 | 0.846 | 0.0040 | 0.136 | 0.128 | 0.322 | 0.489 |
| 65 | 0.0032 | 0.28 | 1.88 | 0.076 | 0.009 | 0.005 | 0.089 | 0.0012 | 0.598 | 0.0020 | 0.132 | 0.486 | 0.428 | 0.367 |
| 66 | 0.0015 | 0.19 | 1.77 | 0.089 | 0.002 | 0.003 | 0.050 | 0.0015 | 0.635 | 0.0010 | — | — | — | — |
| 67 | 0.0015 | 0.22 | 1.84 | 0.100 | 0.002 | 0.017 | 0.055 | 0.0023 | 0.889 | 0.0010 | — | — | — | — |

TABLE 8

| No. | W | V | O | Ta | Co | Sn | Sb | As | Mg | Zr | Ca | REM | Value of formula (2) | Value of formula (3) |
|---|---|---|---|---|---|---|---|---|---|---|---|---|---|---|
| 51 | — | — | — | — | — | — | — | — | — | — | — | — | 220 | 1.18 |
| 52 | — | — | — | — | — | — | — | — | — | — | — | — | 140 | 0.32 |
| 53 | — | — | — | — | — | — | — | — | — | — | — | — | 210 | 0.67 |
| 54 | — | — | — | — | — | — | — | — | — | — | — | — | 126 | 0.25 |
| 55 | — | — | — | — | — | — | — | — | — | — | — | — | 144 | 0.49 |
| 56 | — | — | — | — | — | — | — | — | — | — | — | — | 185 | 0.99 |
| 57 | — | — | — | — | — | — | — | — | — | — | — | — | 118 | 0.52 |
| 58 | — | — | — | — | — | — | — | — | — | — | — | — | 162 | 0.51 |
| 59 | — | — | — | — | — | — | — | — | — | — | — | — | 173 | 0.71 |
| 60 | — | — | — | — | — | — | — | — | — | — | — | — | 162 | 0.42 |
| 61 | — | — | — | — | — | — | — | — | — | — | — | — | 166 | 0.60 |
| 62 | — | — | — | — | — | — | — | — | — | — | — | — | 167 | 0.67 |
| 63 | — | — | — | — | — | — | — | — | — | — | — | — | 166 | 0.56 |
| 64 | 0.035 | 0.220 | 0.002 | 0.022 | 0.122 | 0.199 | 0.121 | 0.033 | 0.026 | 0.027 | 0.0208 | 0.0333 | 162 | 0.42 |
| 65 | 0.015 | 0.194 | 0.002 | 0.032 | 0.151 | 0.422 | 0.271 | 0.043 | 0.042 | 0.017 | 0.0427 | 0.0096 | 172 | 0.52 |
| 66 | — | — | — | — | — | — | — | — | — | — | — | — | 170 | 0.65 |
| 67 | — | — | — | — | — | — | — | — | — | — | — | — | 186 | 0.72 |

TABLE 9

| No. | Manufacturing conditions | | | | | | | | |
|---|---|---|---|---|---|---|---|---|---|
| | Extraction temp. [° C.] | Finish temp. [° C.] | Time after end of finish rolling until start of cooling [s] | Cooling speed (at rapid cooling) [° C./s] | Rapid cooling stop temp. [° C.] | Cooling speed (at slow cooling) [° C./s] | Coiling temp. [° C.] | Annealing temp. [° C.] | Base steel sheet properties Formula (4) satisfied? |
| 51 | 1250 | 920 | 0.3 | 20 | 697 | 4.0 | 120 | 790 | Yes |
| 52 | 1250 | 920 | 0.3 | 20 | 690 | 4.0 | 140 | 790 | Yes |
| 53 | 1250 | 920 | 0.3 | 20 | 685 | 4.0 | 120 | 790 | Yes |
| 54 | 1250 | 920 | 0.3 | 20 | 699 | 4.0 | 130 | 790 | Yes |
| 55 | 1250 | 920 | 0.3 | 20 | 691 | 4.0 | 130 | 790 | Yes |
| 56 | 1250 | 920 | 0.3 | 20 | 693 | 4.0 | 130 | 790 | Yes |
| 57 | 1250 | 920 | 0.3 | 20 | 692 | 4.0 | 120 | 790 | Yes |
| 58 | 1250 | 920 | 1 | 20 | 698 | 4.0 | 140 | 790 | No |
| 59 | 1250 | 920 | 0.3 | 5 | 687 | 4.0 | 130 | 790 | No |
| 60 | 1250 | 920 | 0.3 | 20 | 688 | 7.0 | 140 | 790 | No |
| 61 | 1250 | 920 | 0.3 | 20 | 798 | 4.0 | 120 | 790 | No |
| 62 | 1250 | 920 | 0.3 | 20 | 605 | 4.0 | 280 | 790 | No |
| 63 | 1250 | 920 | 0.3 | 20 | 699 | 4.0 | 120 | 790 | Yes |
| 64 | 1250 | 920 | 0.3 | 20 | 690 | 4.0 | 140 | 790 | Yes |
| 65 | 1250 | 920 | 0.3 | 20 | 685 | 4.0 | 130 | 790 | Yes |
| 66 | 1250 | 920 | 0.3 | 20 | 698 | 4.0 | 120 | 790 | Yes |
| 67 | 1250 | 920 | 0.3 | 20 | 697 | 4.0 | 120 | 790 | Yes |

TABLE 9-continued

| No. | Base steel sheet properties Average grain size [μm] | Mechanical properties YP | TS | EL | Plating and appearance Wettability | Streaks | Shapeability and workability Presence of plating sticking at dies (No: Good, Yes: Poor) | Secondary work embrittlement | Remarks |
|---|---|---|---|---|---|---|---|---|---|
| 51 | 6.4 | 394 | 566 | 29 | Poor | Good | Poor | Good | Comp. ex. |
| 52 | 5.8 | 377 | 528 | 27 | Good | Good | Good | Good | Comp. ex. |
| 53 | 6.0 | 411 | 583 | 25 | Good | Good | Poor | Good | Comp. ex. |
| 54 | 6.1 | 369 | 529 | 28 | Good | Good | Good | Poor | Comp. ex. |
| 55 | 6.2 | 364 | 524 | 29 | Good | Good | Good | Poor | Comp. ex. |
| 56 | 6.1 | 372 | 541 | 29 | Good | Good | Poor | Good | Comp. ex. |
| 57 | 6.2 | 367 | 527 | 24 | Good | Good | Good | Good | Comp. ex. |
| 58 | 9.8 | 331 | 526 | 28 | Good | Good | Poor | Good | Comp. ex. |
| 59 | 10.0 | 331 | 529 | 28 | Good | Good | Poor | Good | Comp. ex. |
| 60 | 10.0 | 332 | 530 | 25 | Good | Good | Poor | Good | Comp. ex. |
| 61 | 10.2 | 320 | 526 | 27 | Good | Good | Poor | Good | Comp. ex. |
| 62 | 9.7 | 338 | 523 | 26 | Good | Good | Poor | Good | Comp. ex. |
| 63 | 5.8 | 373 | 523 | 32 | Good | Good | Good | Good | Ex. |
| 64 | 6.4 | 372 | 532 | 30 | Good | Good | Good | Good | Ex. |
| 65 | 6.1 | 371 | 531 | 29 | Good | Good | Good | Good | Ex. |
| 66 | 6.1 | 370 | 538 | 30 | Good | Good | Good | Good | Ex. |
| 67 | 6.1 | 370 | 529 | 31 | Good | Good | Good | Good | Ex. |

4.1. Results in Regions with Low Mn Content (Tables 1 to 6)

In each of Nos. 1 and 2, the desired mechanical properties etc. were obtained, but the C content of the base steel sheet was too great, therefore the range of annealing conditions for obtaining the desired mechanical properties became narrow and the restrictions at the time of manufacture were great. Further, the value of formula (3) was too large, therefore the plating became slower in alloying, the amount of nonalloyed plating at the alloyed hot-dip galvanized steel sheet became greater, and at the time of press working, the nonalloyed plating stuck to the dies and the shapeability and productivity were impaired.

In each of Nos. 3 and 4, the C content of the base steel sheet was too great, therefore the wettability of the base steel sheet by the plating deteriorated. Further, the value of formula (3) was too large, therefore the plating became slower in alloying, the nonalloyed plating at the alloyed hot-dip galvanized steel sheet became greater, and, at the time of press working, the nonalloyed plating stuck to the dies and the shapeability and productivity were impaired.

In each of Nos. 5 and 6, the Mn content at the base steel sheet was too great, therefore remarkable unevenness of Mn concentration occurred at the surface of the base steel sheet, due to that remarkable unevenness of Mn concentration, unevenness occurred in the alloying speed of the plating, and streak-shaped defects in appearance (plating streaks) formed at the plating surface of the alloyed hot-dip galvanized steel sheet.

In No. 7, the P content at the base steel sheet was too great and, further, the value of formula (3) was too large, therefore the plating became slower in alloying, the nonalloyed plating at the alloyed hot-dip galvanized steel sheet became greater, and, at the time of press working, the nonalloyed plating stuck to the dies and the shapeability and productivity were impaired.

In each of Nos. 8 and 9, the S content at the base steel sheet was too great, therefore secondary work embrittlement occurred due to segregation at the grain boundaries of the base steel sheet. Further, in No. 8, the value of formula (3) was too large, therefore the plating became slower in alloying, the nonalloyed plating at the alloyed hot-dip galvanized steel sheet became greater, and, at the time of press working, the nonalloyed plating stuck to the dies and the shapeability and productivity were impaired.

In each of Nos. 10 and 11, the B content at the base steel sheet was too small, therefore the function of the C removed from the grain boundaries could not be sufficiently compensated for and secondary work embrittlement occurred.

In No. 12, the B content at the base steel sheet was too great and, further, the value of formula (3) was too large, therefore the plating became slower in alloying, the nonalloyed plating at the alloyed hot-dip galvanized steel sheet became greater, and, at the time of press working, the nonalloyed plating stuck to the dies and the shapeability and productivity were impaired.

In No. 13, regarding the chemical composition at the base steel sheet, the value of formula (1) was small and sufficient strength could not be secured.

In No. 14, the time after the end of the finish rolling until the start of cooling became long. Due to this, the average grain size at the base steel sheet became larger, and the mechanical properties fell. Further, the relationship of formula (4) was not satisfied, at the time of alloying of the plating, it became difficult for the Fe to diffuse from the base steel sheet to the plating layer, the alloying speed fell, the nonalloyed plating became greater, and, at the time of press working, the nonalloyed plating stuck to the dies and the shapeability and productivity were impaired.

In No. 15, the cooling speed right after the end of finish rolling was too slow. Due to this, the average grain size at the base steel sheet became larger, and the mechanical properties fell. Further, the relationship of formula (4) was not satisfied, at the time of alloying of the plating, it became difficult for the Fe to diffuse from the base steel sheet to the plating layer, the alloying speed fell, the nonalloyed plating became greater, and, at the time of press working, the nonalloyed plating stuck to the dies and the shapeability and productivity were impaired.

In No. 16, the cooling speed at the time of slow cooling from the rapid cooling stop temperature to the coiling temperature was too fast. Due to this, precipitates were not sufficiently formed, the average grain size at the base steel sheet became larger, and the mechanical properties fell. Further, the relationship of formula (4) was not satisfied, at the time of alloying of the plating, it became difficult for the Fe to diffuse from the base steel sheet to the plating layer, the alloying speed fell, the nonalloyed plating became greater, and, at the time of press working, the nonalloyed plating stuck to the dies and the shapeability and productivity were impaired.

In No. 17, the rapid cooling stop temperature was too high. Due to this, the effect of refinement of the structure was not obtained, the average grain size at the base steel sheet became larger, and the mechanical properties fell. Further, the relationship of formula (4) was not satisfied, at the time of alloying of the plating, it became difficult for the Fe to diffuse from the base steel sheet to the plating layer, the alloying speed fell, the nonalloyed plating became greater, and, at the time of press working, the nonalloyed plating stuck to the dies and the shapeability and productivity were impaired.

In No. 18, the coiling temperature was too high, therefore coherent precipitate could not be utilized, fine, strong precipitates could not be sufficiently made to form at the time of annealing, the average grain size at the base steel sheet became larger, and the mechanical properties fell. Further, the relationship of formula (4) was not satisfied, at the time of alloying of the plating, it became difficult for the Fe to diffuse from the base steel sheet to the plating layer, the alloying speed fell, the nonalloyed plating became greater, and, at the time of press working, the nonalloyed plating stuck to the dies and the shapeability and productivity were impaired.

As opposed to this, in each of Nos. 19 to 50, the wettability of the base steel sheet by the plating was excellent. Further, unevenness of the Mn concentration at the steel sheet surface hardly occurred, formation of plating streaks was suppressed, and the plating appearance was excellent. Further, the alloying speed of the plating was fast, there was little nonalloyed plating, sticking of nonalloyed plating to the dies at the time of press working was suppressed, and the shapeability at the time of press working and the productivity were excellent. Further, secondary work embrittlement at the time of press working could be suppressed.

4.2. Results in Regions with High Mn Content (Tables 7 to 9)

In No. 51, the Si content of the base steel sheet was too great, therefore the wettability of the base steel sheet by the plating deteriorated. Further, the value of formula (3) was too large, therefore the plating became slower in alloying, the nonalloyed plating at the alloyed hot-dip galvanized steel sheet became greater, and, at the time of press working, the nonalloyed plating stuck to the dies and the shapeability and productivity were impaired.

In No. 52, the Mn content at the base steel sheet was just too large, therefore the elongation tended to fall. Further, the value of formula (2) was small and a high strength could not be secured despite Mn being excessively included.

In No. 53, the P content at the base steel sheet was too large, therefore the plating became slower in alloying, the nonalloyed plating at the alloyed hot-dip galvanized steel sheet became greater, and, at the time of press working, the nonalloyed plating stuck to the dies and the shapeability and productivity were impaired.

In No. 54, the S content at the base steel sheet was too large, therefore secondary work embrittlement occurred due to segregation at the grain boundaries of the base steel sheet. Further, the value of formula (2) was small, therefore the mechanical properties tended to fall.

In No. 55, the B content at the base steel sheet was too small, therefore the function of the C removed from the grain boundaries could not be sufficiently compensated for and secondary work embrittlement occurred. Further, the value of formula (2) was small, therefore the mechanical properties tended to fall.

In No. 56, the B content at the base steel sheet was too great and, further, the value of formula (3) was too large, therefore the plating became slower in alloying, the nonalloyed plating at the alloyed hot-dip galvanized steel sheet became greater, and, at the time of press working, the nonalloyed plating stuck to the dies and the shapeability and productivity were impaired.

In No. 57, the value of formula (2) was small and, further, the Ti content was too small, therefore the mechanical properties tended to fall.

In No. 58, the time after the end of the finish rolling until the start of cooling was long. Due to this, the average grain size at the base steel sheet became larger, and the mechanical properties fell. Further, the relationship of formula (4) was not satisfied, at the time of alloying of the plating, it became difficult for the Fe to diffuse from the base steel sheet to the plating layer, the alloying speed fell, the nonalloyed plating became greater, and, at the time of press working, the nonalloyed plating stuck to the dies and the shapeability and productivity were impaired.

In No. 59, the cooling speed right after the end of finish rolling was too slow. Due to this, the average grain size at the base steel sheet became larger, and the mechanical properties fell. Further, the relationship of formula (4) was not satisfied, at the time of alloying of the plating, it became difficult for the Fe to diffuse from the base steel sheet to the plating layer, the alloying speed fell, the nonalloyed plating became greater, and, at the time of press working, the nonalloyed plating stuck to the dies and the shapeability and productivity were impaired.

In No. 60, the cooling speed at the time of slow cooling from the rapid cooling stop temperature to the coiling temperature was too fast. Due to this, precipitates were not sufficiently formed, the average grain size at the base steel sheet became larger, and the mechanical properties fell. Further, the relationship of formula (4) was not satisfied, at the time of alloying of the plating, it became difficult for the Fe to diffuse from the base steel sheet to the plating layer, the alloying speed fell, the nonalloyed plating became greater, and, at the time of press working, the nonalloyed plating stuck to the dies and the shapeability and productivity were impaired.

In No. 61, the rapid cooling stop temperature was too high. Due to this, the effect of refinement of the structure was not obtained, the average grain size at the base steel sheet became larger, and the mechanical properties fell. Further, the relationship of formula (4) was not satisfied, at the time of alloying of the plating, it became difficult for the Fe to diffuse from the base steel sheet to the plating layer, the alloying speed fell, the nonalloyed plating became greater, and, at the time of press working, the nonalloyed plating stuck to the dies and the shapeability and productivity were impaired.

In No. 62, the coiling temperature was too high, therefore coherent precipitate could not be utilized, fine, strong precipitates could not be sufficiently made to form at the time of annealing, the average grain size at the base steel sheet became larger, and the mechanical properties fell. Further, the relationship of formula (4) was not satisfied, at the time of alloying of the plating, it became difficult for the Fe to diffuse from the base steel sheet to the plating layer, the alloying speed fell, the nonalloyed plating became greater, and, at the time of press working, the nonalloyed plating stuck to the dies and the shapeability and productivity were impaired.

As opposed to this, in each of Nos. 63 to 67, the wettability of the base steel sheet by the plating was excellent. Further, unevenness of concentration of Mn at the steel sheet surface became difficult to occur, formation of plating streaks was suppressed, and the plating appearance became excellent. Further, the alloying speed of the plating was fast, there was little nonalloyed plating, sticking of the nonalloyed plating to the dies at the time of press working was suppressed, and the shapeability and productivity at the time of press working were excellent. Further, secondary work embrittlement at the time of press working could be suppressed.

4.3. Summary

Summarizing the above results, it will be understood that the alloyed hot-dip galvanized steel sheet satisfying the following requirements (I) to (III) is excellent in wettability of the base steel sheet by plating, formation of plating streaks is suppressed, sticking of nonalloyed plating to the dies at the time of press working is suppressed, and secondary work embrittlement is also easily suppressed.

(I) The chemical composition of the base steel sheet comprises, by mass %,

C: 0.0005 to 0.0100%,
Si: 0.01 to 0.50%,
Mn: 0.01 to 1.30% or 1.70 to 2.00%,
P: 0.100% or less,
S: 0.010% or less,
N: 0.0200% or less,
Ti: 0.040 to 0.180%,
Nb: 0 to 0.100%,
B: 0.0005 to 0.0100%,
Al: 0 to 1.000%,
Cu: 0 to 1.000%,
Cr: 0 to 2.000%,
Ni: 0 to 0.500%,
Mo: 0 to 3.000%,
W: 0 to 0.100%,
V: 0 to 1.000%,
O: 0 to 0.020%,
Ta: 0 to 0.100%,
Co: 0 to 3.000%,
Sn: 0 to 1.000%,
Sb: 0 to 0.500%,
As: 0 to 0.050%,
Mg: 0 to 0.050%,
Zr: 0 to 0.050%,
Ca: 0 to 0.0500%,
REM: 0 to 0.0500%, and
a balance: Fe and impurities.

(II) If the Mn content of the base steel sheet is, by mass %, 0 to 1.30%, the relationships of the following formulas (1) and (3) are satisfied, if the Mn content of the base steel sheet is, by mass %, 1.70 to 2.00%, the relationships of the following formulas (2) and (3) are satisfied, and the amounts of Mn, P, S, Ti, and Nb in the extraction residue obtained by analysis of the extraction residue of the base steel sheet satisfy the relationship of the following formula (4).

$$130 \leq 100[\mathrm{Si}] + 40[\mathrm{Mn}] + 900[\mathrm{P}] \quad (1)$$

$$160 \leq 100[\mathrm{Si}] + 40[\mathrm{Mn}] + 900[\mathrm{P}] \quad (2)$$

$$15(2[\mathrm{C}] - ([\mathrm{Ti}] - 4[\mathrm{N}])/3 - [\mathrm{Nb}]/8) + 7[\mathrm{P}] + [\mathrm{Si}] + 20[\mathrm{B}] \leq 0.75 \quad (3)$$

$$[\mathrm{C}]/12 \leq [X_{Ti}]/48 + [X_{Nb}]/93 \leq [\mathrm{C}]/12 + [\mathrm{N}]/14 + [X_P]/31 - ([X_S]/32 - [X_{Mn}]/55) \quad (4)$$

(III) The average grain diameter of the base steel sheet is 7.5 μm or less.

The invention claimed is:

1. An alloyed hot-dip galvanized steel sheet, comprising a base steel sheet and plating layer, wherein a chemical composition of the base steel sheet comprises, by mass %, C: 0.0005 to 0.0100%,
Si: 0.01 to 0.50%,
Mn: 0.01 to 1.30% or,
P: 0.100% or less,
S: 0.010% or less,
N: 0.0200% or less,
Ti: 0.040 to 0.180%,
Nb: 0 to 0.100%,
B: 0.0005 to 0.0100%,
Al: 0 to 1.000%,
Cu: 0 to 1.000%,
Cr: 0 to 2.000%,
Ni: 0 to 0.500%,
Mo: 0 to 3.000%,
W: 0 to 0.100%,
V: 0 to 1.000%,
O: 0 to 0.020%,
Ta: 0 to 0.100%,
Co: 0 to 3.000%,
Sn: 0 to 1.000%,
Sb: 0 to 0.500%,
As: 0 to 0.050%,
Mg: 0 to 0.050%,
Zr: 0 to 0.050%,
Ca: 0 to 0.0500%,
REM: 0 to 0.0500%, and
a balance: Fe and impurities, formulas (1) and (3) are satisfied, the amounts of Mn, P, S, Ti, and Nb in an extraction residue of the base steel sheet obtained by analysis of the extraction residue of the base steel sheet satisfy formula (4), and the average grain diameter of the base steel sheet is 7.5 μm or less:

$$130 \leq 100[\mathrm{Si}] + 40[\mathrm{Mn}] + 900[\mathrm{P}] \quad (1)$$

$$15(2[\mathrm{C}] - ([\mathrm{Ti}] - 4[\mathrm{N}])/3 - [\mathrm{Nb}]/8) + 7[\mathrm{P}] + [\mathrm{Si}] + 20[\mathrm{B}] \leq 0.75 \quad (3)$$

$$[\mathrm{C}]/12 \leq [X_{Ti}]/48 + [X_{Nb}]/93 \leq [\mathrm{C}]/12 + [\mathrm{N}]/14 + [X_P]/31 - ([X_S]/32 - [X_{Mn}]/55) \quad (4)$$

in the above formulas,

[C], [Si], [Mn], [P], [N], [Ti], and [Nb] are contents (mass %) of the elements in the chemical composition, and $[X_{Ti}]$, $[X_{Nb}]$, $[X_P]$, $[X_S]$, and $[X_{Mn}]$ are expressed by formulas (A) to (E):

$$[X_{Ti}]=[(\text{Ti mass in extraction residue})/(\text{mass of electrolyzed base steel sheet})]\times 100 \quad (A)$$

$$[X_{Nb}]=[(\text{Nb mass in extraction residue})/(\text{mass of electrolyzed base steel sheet})]\times 100 \quad (B)$$

$$[X_P]=[(\text{P mass in extraction residue})/(\text{mass of electrolyzed base steel sheet})]\times 100 \quad (C)$$

$$[X_S]=[(\text{S mass in extraction residue})/(\text{mass of electrolyzed base steel sheet})]\times 100 \quad (D)$$

$$[X_{Mn}]=[(\text{Mn mass in extraction residue})/(\text{mass of electrolyzed base steel sheet})]\times 100 \quad (E).$$

2. The alloyed hot-dip galvanized steel sheet according to claim 1, wherein the chemical composition comprises, by mass %, one or more of:

Nb: 0.001 to 0.100%,
Al: 0.001 to 1.000%,
Cu: 0.001 to 1.000%,
Cr: 0.001 to 2.000%,
Ni: 0.001 to 0.500%,
Mo: 0.001 to 3.000%,
W: 0.001 to 0.100%,
V: 0.001 to 1.000%,
O: 0.001 to 0.020%,
Ta: 0.001 to 0.100%,
Co: 0.001 to 3.000%,
Sn: 0.001 to 1.000%,
Sb: 0.001 to 0.500%,
As: 0.001 to 0.050%,
Mg: 0.001 to 0.050%,
Zr: 0.001 to 0.050%,
Ca: 0.0001 to 0.0500%, and
REM: 0.0001 to 0.0500%.

3. The alloyed hot-dip galvanized steel sheet according to claim 1, wherein the microstructure of the base steel sheet is, by area ratio,
ferrite: 94 to 100%,
total of martensite and bainite: 0 to 4%, and
retained austenite: 0 to 2%.

4. The alloyed hot-dip galvanized steel sheet according to claim 1, wherein, a chemical composition of the plating layer comprises, by mass %,
Fe: 5.0 to 25.0%,
Al: 0 to 1.0%,
Si: 0 to 1.0%,
Mg: 0 to 1.0%,
Mn: 0 to 1.0%,
Ni: 0 to 1.0%,
Sb: 0 to 1.0%, and
balance: Zn and impurities.

5. The alloyed hot-dip galvanized steel sheet according to claim 2, wherein the microstructure of the base steel sheet is, by area ratio,
ferrite: 94 to 100%,
total of martensite and bainite: 0 to 4%, and
retained austenite: 0 to 2%.

6. The alloyed hot-dip galvanized steel sheet according to claim 2, wherein, a chemical composition of the plating layer comprises, by mass %,
Fe: 5.0 to 25.0%,
Al: 0 to 1.0%,
Si: 0 to 1.0%,
Mg: 0 to 1.0%,
Mn: 0 to 1.0%,
Ni: 0 to 1.0%,
Sb: 0 to 1.0%, and
a balance: Zn and impurities.

7. The alloyed hot-dip galvanized steel sheet according to claim 5, wherein, a chemical composition of the plating layer comprises, by mass %,
Fe: 5.0 to 25.0%,
Al: 0 to 1.0%,
Si: 0 to 1.0%,
Mg: 0 to 1.0%,
Mn: 0 to 1.0%,
Ni: 0 to 1.0%,
Sb: 0 to 1.0%, and
a balance: Zn and impurities.

* * * * *